US009120111B2

(12) United States Patent
Nations et al.

(10) Patent No.: US 9,120,111 B2
(45) Date of Patent: Sep. 1, 2015

(54) ARC ADJUSTABLE ROTARY SPRINKLER HAVING FULL-CIRCLE OPERATION AND AUTOMATIC MATCHED PRECIPITATION

(71) Applicant: Rain Bird Corporation, Azusa, CA (US)

(72) Inventors: Derek Michael Nations, Tucson, AZ (US); Kenneth J. Skripkar, Tucson, AZ (US); Jorge Alfredo Duenas Lebron, Nogales (MX)

(73) Assignee: Rain Bird Corporation, Azusa, CA (US)

( * ) Notice: Subject to any disclaimer, the term of this patent is extended or adjusted under 35 U.S.C. 154(b) by 304 days.

(21) Appl. No.: 13/776,044

(22) Filed: Feb. 25, 2013

(65) Prior Publication Data

US 2013/0221128 A1 Aug. 29, 2013

Related U.S. Application Data

(60) Provisional application No. 61/602,948, filed on Feb. 24, 2012.

(51) Int. Cl.

| | |
|---|---|
| ***B05B 15/04*** | (2006.01) |
| ***B05B 3/04*** | (2006.01) |
| ***B05B 15/10*** | (2006.01) |
| ***B05B 15/02*** | (2006.01) |

(52) U.S. Cl.

CPC ..... *B05B 15/04* (2013.01); *B05B 3/0436* (2013.01); *B05B 3/0454* (2013.01); *B05B 15/025* (2013.01); *B05B 15/0241* (2013.01); *B05B 15/10* (2013.01)

(58) Field of Classification Search

CPC ..... B05B 3/06; B05B 15/06; B05B 15/10; B05B 3/02

USPC ..... 239/201, 203, 204, 205, 206, 210, 214, 239/214.21, 214.23, 220, 225.1, 228, 255, 239/257, 262, 569, 580, DIG. 1, DIG. 12, 239/601, 537, 451, 457

See application file for complete search history.

(56) References Cited

U.S. PATENT DOCUMENTS

| | | | |
|---|---|---|---|
| 2,625,411 | A | 4/1949 | Unger |
| 2,721,052 | A | 10/1955 | Hull |
| 2,950,132 | A | 11/1957 | Kocsuta |
| 2,999,701 | A | 9/1961 | Blair |
| 3,091,399 | A | 5/1963 | Kennedy |

(Continued)

FOREIGN PATENT DOCUMENTS

| | | |
|---|---|---|
| EP | 1864717 | 12/2007 |
| WO | 2004113777 | 12/2004 |

(Continued)

OTHER PUBLICATIONS

International Search Report, International Patent Application No. PCT/US2013/050072, dated Nov. 7, 2013, 2 pages.

*Primary Examiner* — Melanie Tyson
*Assistant Examiner* — Christopher R Dandridge
(74) *Attorney, Agent, or Firm* — Fitch, Even, Tabin & Flannery, LLP

(57) ABSTRACT

A rotary sprinkler including a rotatable nozzle turret with automatic matched precipitation to an arc of rotation, a nozzle purge feature, and/or a flow shut off valve coupled to a variable flow nozzle outlet.

4 Claims, 17 Drawing Sheets

(56) References Cited

U.S. PATENT DOCUMENTS

| | | | |
|---|---|---|---|
| 3,095,148 | A | 6/1963 | Smith |
| 3,107,056 | A | 10/1963 | Hunter |
| 3,135,259 | A | 6/1964 | Evans |
| 3,204,988 | A | 9/1965 | Ouderkirk |
| 3,244,373 | A | 4/1966 | Hait |
| 3,940,066 | A | 2/1976 | Hunter |
| 4,059,227 | A | 11/1977 | Hunter |
| 4,119,275 | A | 10/1978 | Hunter |
| 4,149,358 | A | 4/1979 | Comer |
| 4,198,000 | A | 4/1980 | Hunter |
| 4,204,642 | A | 5/1980 | Hunter |
| 4,220,283 | A | 9/1980 | Citron |
| 4,265,404 | A | 5/1981 | Hunter |
| 4,272,024 | A | 6/1981 | Kah |
| 4,301,967 | A | 11/1981 | Hunter |
| 4,398,666 | A | 8/1983 | Hunter |
| 4,406,440 | A | 9/1983 | Kulle |
| 4,451,635 | A | 5/1984 | Gould |
| 4,471,908 | A | 9/1984 | Hunter |
| 4,501,391 | A | 2/1985 | Hunter |
| 4,559,653 | A | 12/1985 | Mathews |
| 4,569,485 | A | 2/1986 | Walto |
| 4,624,412 | A | 11/1986 | Hunter |
| 4,634,052 | A | 1/1987 | Grizzle |
| 4,635,975 | A | 1/1987 | Campbell |
| 4,637,636 | A | 1/1987 | Guest |
| 4,682,755 | A | 7/1987 | Bernstein |
| 4,708,290 | A | 11/1987 | Osmond |
| 4,732,861 | A | 3/1988 | Sinclair |
| 4,867,378 | A | 9/1989 | Kah |
| 4,919,337 | A | 4/1990 | VanLeeuwen |
| 4,955,542 | A | 9/1990 | Kah |
| 4,961,534 | A | 10/1990 | Tyler |
| 4,972,993 | A | 11/1990 | VanLeeuwen |
| 5,009,368 | A | 4/1991 | Streck |
| 5,031,840 | A | 7/1991 | Grundy |
| 5,050,800 | A | 9/1991 | Lamar |
| 5,052,621 | A | 10/1991 | Katzer |
| 5,097,861 | A | 3/1992 | Hopkins |
| 5,098,021 | A | 3/1992 | Kah |
| 5,115,977 | A | 5/1992 | Alkalay |
| 5,148,990 | A | 9/1992 | Kah |
| 5,148,991 | A | 9/1992 | Kah |
| 5,158,232 | A | 10/1992 | Tyler |
| 5,226,602 | A | 7/1993 | Cochran |
| 5,239,587 | A | 8/1993 | Muckelrath |
| 5,251,938 | A | 10/1993 | Erickson |
| 5,259,587 | A | 11/1993 | DAlessio |
| 5,288,023 | A | 2/1994 | Han |
| 5,291,842 | A | 3/1994 | Sallstrom |
| 5,330,103 | A | 7/1994 | Eckstein |
| 5,360,167 | A | 11/1994 | Grundy |
| 5,375,768 | A | 12/1994 | Clark |
| 5,383,600 | A | 1/1995 | Verbera |
| 5,394,678 | A | 3/1995 | Lonn |
| 5,417,370 | A | 5/1995 | Kah |
| 5,444,611 | A | 8/1995 | Woytowitz |
| RE35,037 | E | 9/1995 | Kah |
| 5,456,411 | A | 10/1995 | Scott |
| 5,462,251 | A | 10/1995 | Kawabe |
| 5,487,572 | A | 1/1996 | Combot-Courrau |
| 5,526,982 | A | 6/1996 | McKenzie |
| 5,527,073 | A | 6/1996 | Readman |
| 5,556,036 | A | 9/1996 | Chase |
| 5,588,594 | A | 12/1996 | Kah |
| 5,611,488 | A | 3/1997 | Frolich |
| 5,630,551 | A | 5/1997 | Forcier |
| 5,653,390 | A | 8/1997 | Kah |
| 5,673,855 | A | 10/1997 | Nguyen |
| 5,676,315 | A | 10/1997 | Han |
| 5,681,062 | A | 10/1997 | Fukao |
| 5,685,486 | A | 11/1997 | Spenser |
| D388,502 | S | 12/1997 | Kah |
| 5,695,122 | A | 12/1997 | Messinger |
| 5,695,123 | A | 12/1997 | Le |
| 5,695,224 | A | 12/1997 | Grenier |
| 5,699,962 | A | 12/1997 | Scott |
| 5,709,417 | A | 1/1998 | Verbeck |
| 5,722,593 | A | 3/1998 | McKenzie |
| 5,758,827 | A | 6/1998 | Van Le |
| 5,762,270 | A | 6/1998 | Kearby |
| 5,765,757 | A | 6/1998 | Bendall |
| 5,816,627 | A | 10/1998 | Readman |
| 5,823,440 | A | 10/1998 | Clark |
| 5,826,797 | A | 10/1998 | Kah |
| 5,868,316 | A | 2/1999 | Scott |
| 5,899,386 | A | 5/1999 | Miyasato |
| 5,911,443 | A | 6/1999 | LeQuere |
| 5,938,122 | A | 8/1999 | Heren |
| 5,975,430 | A | 11/1999 | Larsen |
| 5,992,760 | A | 11/1999 | Kearby |
| 6,000,632 | A | 12/1999 | Wallace |
| 6,029,907 | A | 2/2000 | McKenzie |
| 6,039,268 | A | 3/2000 | Grundy |
| 6,042,021 | A | 3/2000 | Clark |
| 6,050,502 | A * | 4/2000 | Clark ..... 239/237 |
| 6,085,995 | A | 7/2000 | Kah |
| 6,109,545 | A | 8/2000 | Kah |
| 6,109,664 | A | 8/2000 | Guest |
| 6,138,924 | A | 10/2000 | Hunter |
| 6,155,493 | A | 12/2000 | Kearby |
| 6,168,577 | B1 | 1/2001 | Niederjohn |
| 6,182,909 | B1 | 2/2001 | Kah |
| 6,209,801 | B1 | 4/2001 | Kearby |
| 6,227,455 | B1 | 5/2001 | Scott |
| 6,231,090 | B1 | 5/2001 | Fukao |
| 6,237,862 | B1 | 5/2001 | Kah |
| 6,241,158 | B1 | 6/2001 | Clark |
| 6,244,521 | B1 | 6/2001 | Sesser |
| 6,293,147 | B1 | 9/2001 | Parker |
| 6,336,597 | B1 | 1/2002 | Kah |
| 6,351,929 | B1 | 3/2002 | Gust |
| 6,364,217 | B1 | 4/2002 | Lockwood |
| 6,464,151 | B1 | 10/2002 | Cordua |
| 6,488,401 | B1 | 12/2002 | Seaman |
| 6,491,235 | B1 | 12/2002 | Scott |
| 6,494,384 | B1 | 12/2002 | Meyer |
| 6,499,672 | B1 | 12/2002 | Sesser |
| 6,568,608 | B2 | 5/2003 | Sirkin |
| 6,601,781 | B2 | 8/2003 | Kah |
| 6,612,623 | B2 | 9/2003 | Salomon-Bahls |
| 6,637,672 | B2 | 10/2003 | Cordua |
| 6,651,905 | B2 | 11/2003 | Sesser |
| 6,655,830 | B1 | 12/2003 | Seaman |
| 6,663,145 | B1 | 12/2003 | Lyall, III |
| 6,695,223 | B2 | 2/2004 | Beutler |
| 6,712,796 | B2 | 3/2004 | Fentis |
| 6,721,630 | B1 | 4/2004 | Woytowitz |
| 6,722,629 | B1 | 4/2004 | Nakazawa |
| 6,732,950 | B2 | 5/2004 | Ingham |
| 6,732,952 | B2 | 5/2004 | Kah |
| 6,736,332 | B2 | 5/2004 | Sesser |
| 6,799,732 | B2 | 10/2004 | Sirkin |
| 6,802,458 | B2 | 10/2004 | Gregory |
| 6,814,305 | B2 | 11/2004 | Townsend |
| 6,817,543 | B2 | 11/2004 | Clark |
| 6,824,172 | B1 | 11/2004 | Komolrochanaporn |
| 6,827,291 | B2 | 12/2004 | Townsend |
| 6,834,816 | B2 | 12/2004 | Kah |
| 6,840,460 | B2 | 1/2005 | Clark |
| 6,842,667 | B2 | 1/2005 | Beutler |
| 6,848,124 | B2 | 2/2005 | Goettl |
| 6,848,632 | B2 | 2/2005 | Clark |
| 6,854,664 | B2 | 2/2005 | Smith |
| 6,869,026 | B2 | 3/2005 | McKenzie |
| 6,871,795 | B2 | 3/2005 | Anuskiewicz |
| 6,883,727 | B2 | 4/2005 | De Los Santos |
| 6,896,881 | B1 | 5/2005 | Russell |
| 6,899,355 | B2 | 5/2005 | Klein |
| 6,913,292 | B2 | 7/2005 | Snyder, Sr. |
| 6,921,029 | B2 | 7/2005 | Lockwood |
| 6,929,236 | B1 | 8/2005 | Height |
| 6,942,164 | B2 | 9/2005 | Walker |
| 6,945,471 | B2 | 9/2005 | McKenzie |

(56) References Cited

U.S. PATENT DOCUMENTS

| | | | | |
|---|---|---|---|---|
| 6,957,782 | B2 | 10/2005 | Clark | |
| 6,988,747 | B2 | 1/2006 | Allen | |
| 6,991,362 | B1 | 1/2006 | Seaman | |
| 7,010,394 | B1 | 3/2006 | Runge | |
| 7,017,831 | B2 | 3/2006 | Santiago | |
| 7,028,920 | B2 | 4/2006 | Hekman | |
| 7,032,836 | B2 | 4/2006 | Sesser | |
| 7,032,844 | B2 | 4/2006 | Cordua | |
| 7,040,553 | B2 | 5/2006 | Clark | |
| 7,044,403 | B2 | 5/2006 | Kah | |
| 7,090,146 | B1 | 8/2006 | Ericksen | |
| 7,111,875 | B2 | 9/2006 | Ball | |
| 7,121,593 | B2 | 10/2006 | Snyder, Sr. | |
| 7,133,749 | B2 | 11/2006 | Goldberg | |
| 7,134,613 | B2 | 11/2006 | Kah, III | |
| 7,143,692 | B2 | 12/2006 | Schmitt | |
| 7,143,962 | B2 | 12/2006 | Kah | |
| 7,152,814 | B1 | 12/2006 | Schapper | |
| 7,159,795 | B2 | 1/2007 | Sesser | |
| 7,168,632 | B2 | 1/2007 | Kates | |
| 7,195,287 | B2 | 3/2007 | Wai | |
| 7,225,057 | B2 | 5/2007 | Froman | |
| 7,226,003 | B2 | 6/2007 | Kah | |
| 7,232,078 | B2 | 6/2007 | Kah, Jr. | |
| 7,232,081 | B2 | 6/2007 | Kah | |
| 7,234,651 | B2 | 6/2007 | Mousavi | |
| 7,255,291 | B1 | 8/2007 | Lo | |
| 7,287,711 | B2 | 10/2007 | Crooks | |
| 7,287,712 | B2 | 10/2007 | Kah, Jr. | |
| 7,322,533 | B2 | 1/2008 | Grizzle | |
| 7,325,753 | B2 | 2/2008 | Gregory | |
| 7,337,988 | B2 | 3/2008 | McCormick | |
| 7,363,113 | B2 | 4/2008 | Runge | |
| RE40,440 | E | 7/2008 | Sesser | |
| 7,392,936 | B1 | 7/2008 | Green | |
| 7,392,956 | B2 | 7/2008 | McKenzie | |
| 7,404,525 | B2 | 7/2008 | Santiago | |
| 7,412,303 | B1 | 8/2008 | Porter | |
| 7,422,752 | B2 | 9/2008 | Hirst | |
| 7,429,005 | B2 | 9/2008 | Schapper | |
| 7,472,840 | B2 | 1/2009 | Gregory | |
| 7,478,526 | B2 | 1/2009 | McAfee | |
| 7,500,619 | B2 | 3/2009 | Lockwood | |
| 7,500,620 | B2 | 3/2009 | Cordua | |
| 7,500,699 | B2 | 3/2009 | Snyder, Sr. | |
| 7,530,606 | B1 | 5/2009 | Yang | |
| 7,552,632 | B2 | 6/2009 | Runge | |
| 7,574,284 | B2 | 8/2009 | Goldberg | |
| 7,578,010 | B2 | 8/2009 | Goettl | |
| 7,581,687 | B2 | 9/2009 | Feith | |
| 7,584,023 | B1 | 9/2009 | Palmer | |
| 7,590,471 | B2 | 9/2009 | Jacobsen | |
| 7,597,273 | B2 | 10/2009 | McAfee | |
| 7,611,077 | B2 | 11/2009 | Sesser | |
| 7,621,464 | B2 | 11/2009 | Smith | |
| 7,621,467 | B1 | 11/2009 | Garcia | |
| 7,624,934 | B2 | 12/2009 | Breedlove | |
| 7,629,590 | B2 | 12/2009 | Horsky | |
| 7,677,469 | B1 | 3/2010 | Clark | |
| 7,686,236 | B2 | 3/2010 | Alexander | |
| 7,703,706 | B2 | 4/2010 | Walker | |
| 7,717,475 | B2 | 5/2010 | Savelle | |
| 7,748,646 | B2 | 7/2010 | Clark | |
| 7,761,189 | B2 | 7/2010 | Froman | |
| 7,766,259 | B2 | 8/2010 | Feith | |
| 7,766,396 | B1 | 8/2010 | Elbaz | |
| 7,793,868 | B2 | 9/2010 | Kah | |
| 7,820,981 | B2 | 10/2010 | Horsky | |
| 7,823,804 | B2 | 11/2010 | Cordua | |
| 7,828,229 | B2 | 11/2010 | Kah | |
| 7,834,816 | B2 | 11/2010 | Marino | |
| 7,841,547 | B2 | 11/2010 | Kah | |
| 7,850,094 | B2 | 12/2010 | Richmond | |
| 7,853,363 | B1 | 12/2010 | Porter | |
| 7,861,948 | B1 | 1/2011 | Crooks | |
| 7,862,089 | B2 | 1/2011 | Crompton | |
| 7,877,168 | B1 | 1/2011 | Porter | |
| 7,912,588 | B2 | 3/2011 | Runge | |
| 7,917,249 | B2 | 3/2011 | Jacobsen | |
| 7,942,161 | B2 | 5/2011 | Crompton | |
| 7,962,245 | B2 | 6/2011 | Runge | |
| RE42,596 | E | 8/2011 | Sesser | |
| 7,988,071 | B2 | 8/2011 | Bredberg | |
| 8,006,919 | B2 | 8/2011 | Renquist | |
| 8,020,788 | B2 | 9/2011 | Luettgen | |
| 8,025,315 | B2 | 9/2011 | Schreckenberg | |
| 8,033,578 | B2 | 10/2011 | DeWilde | |
| 8,047,456 | B2 | 11/2011 | Kah | |
| 8,074,456 | B2 | 12/2011 | Shah | |
| 8,074,897 | B2 | 12/2011 | Hunnicutt | |
| 8,113,443 | B2 | 2/2012 | Zur | |
| 8,136,742 | B2 | 3/2012 | Cordua | |
| 8,136,743 | B2 | 3/2012 | Kah, Jr. | |
| 8,205,915 | B1 | 6/2012 | Crompton | |
| 8,469,288 | B1 | 6/2013 | Clark | |
| 8,474,733 | B1 | 7/2013 | Clark | |
| 8,628,027 | B2 * | 1/2014 | Kah et al. | 239/242 |
| 8,636,229 | B1 | 1/2014 | Clark | |
| 8,636,230 | B1 * | 1/2014 | Clark et al. | 239/242 |
| 8,636,233 | B2 | 1/2014 | Clark | |
| 8,727,238 | B1 | 5/2014 | Clark | |
| 8,777,124 | B2 | 7/2014 | Clark | |
| 8,955,767 | B1 | 2/2015 | Clark et al. | |
| 8,955,768 | B1 | 2/2015 | Clark et al. | |
| 8,991,725 | B2 | 3/2015 | Kah, Jr. | |
| 8,991,726 | B2 * | 3/2015 | Kah et al. | 239/230 |
| 8,991,730 | B2 | 3/2015 | Kah, Jr. et al. | |
| 2001/0013557 | A1 | 8/2001 | Kah | |
| 2002/0023972 | A1 | 2/2002 | Kah | |
| 2002/0074432 | A1 | 6/2002 | Kah | |
| 2002/0089175 | A1 | 7/2002 | Ericksen | |
| 2002/0130202 | A1 | 9/2002 | Kah | |
| 2002/0135184 | A1 | 9/2002 | Snyder | |
| 2002/0158145 | A1 | 10/2002 | Schneider | |
| 2003/0006306 | A1 | 1/2003 | Clark | |
| 2003/0006307 | A1 | 1/2003 | Clark | |
| 2003/0010842 | A1 | 1/2003 | Kah | |
| 2003/0075620 | A1 | 4/2003 | Kah | |
| 2003/0089796 | A1 | 5/2003 | Kah | |
| 2003/0124704 | A1 | 7/2003 | Strittmatter | |
| 2003/0155433 | A1 | 8/2003 | Gregory | |
| 2004/0014053 | A1 | 1/2004 | Zerhusen | |
| 2004/0050958 | A1 | 3/2004 | McKenzie | |
| 2004/0108392 | A1 | 6/2004 | Kah | |
| 2004/0164178 | A1 | 8/2004 | Kah | |
| 2004/0195358 | A1 | 10/2004 | Santiago | |
| 2004/0195400 | A1 | 10/2004 | Anuskiewicz | |
| 2004/0239115 | A1 | 12/2004 | Wilk | |
| 2004/0241703 | A1 | 12/2004 | DeSauvage | |
| 2005/0009105 | A1 | 1/2005 | Goddard | |
| 2005/0042216 | A1 | 2/2005 | Frantz | |
| 2005/0054576 | A1 | 3/2005 | Siler-Khodr | |
| 2005/0103887 | A1 | 5/2005 | McCormick | |
| 2005/0103901 | A1 | 5/2005 | Kah | |
| 2005/0133619 | A1 | 6/2005 | Clark | |
| 2005/0146133 | A1 | 7/2005 | Snyder | |
| 2005/0161534 | A1 | 7/2005 | Kah | |
| 2005/0173557 | A1 | 8/2005 | Kah | |
| 2005/0194461 | A1 | 9/2005 | Goldberg | |
| 2005/0214218 | A1 | 9/2005 | Russell | |
| 2005/0233448 | A1 | 10/2005 | Oh | |
| 2006/0049275 | A1 | 3/2006 | Santiago | |
| 2006/0184284 | A1 | 8/2006 | Froman | |
| 2006/0219815 | A1 | 10/2006 | Hekman | |
| 2006/0265852 | A1 | 11/2006 | Snyder | |
| 2006/0278727 | A1 | 12/2006 | Kah | |
| 2007/0034712 | A1 | 2/2007 | Kah | |
| 2007/0075542 | A1 | 4/2007 | Glaze | |
| 2007/0119975 | A1 | 5/2007 | Hunnicutt | |
| 2007/0119976 | A1 | 5/2007 | Kah | |
| 2007/0119978 | A1 | 5/2007 | Wang | |
| 2007/0128315 | A1 | 6/2007 | Szydlowski | |
| 2007/0131802 | A1 | 6/2007 | Kah | |
| 2007/0235565 | A1 | 10/2007 | Kah | |

(56) References Cited

U.S. PATENT DOCUMENTS

| | | | |
|---|---|---|---|
| 2008/0034859 | A1 | 2/2008 | Runge |
| 2008/0054092 | A1 | 3/2008 | Alexander |
| 2008/0087743 | A1 | 4/2008 | Govrin |
| 2008/0128531 | A1 | 6/2008 | Kah |
| 2008/0142618 | A1 | 6/2008 | Smith |
| 2008/0257982 | A1 | 10/2008 | Kah |
| 2009/0053226 | A1 | 2/2009 | Crowley |
| 2009/0065606 | A1 | 3/2009 | Lee |
| 2009/0072048 | A1 | 3/2009 | Renquist |
| 2009/0130315 | A1 | 5/2009 | Vogel |
| 2009/0173803 | A1 | 7/2009 | Kah |
| 2009/0173804 | A1 | 7/2009 | Kah |
| 2009/0177330 | A1 | 7/2009 | Kah |
| 2009/0188988 | A1 | 7/2009 | Walker |
| 2009/0278556 | A1 | 11/2009 | Man |
| 2010/0029053 | A1 | 2/2010 | Itokawa |
| 2010/0090024 | A1 | 4/2010 | Hunnicutt |
| 2010/0098632 | A1 | 4/2010 | Russell |
| 2010/0105865 | A1 | 4/2010 | Telford |
| 2010/0108787 | A1 | 5/2010 | Walker |
| 2010/0179310 | A1 | 7/2010 | Kamme |
| 2010/0187331 | A1 | 7/2010 | Clark |
| 2010/0236936 | A1 | 9/2010 | Brunner |
| 2010/0243762 | A1 | 9/2010 | Onofrio |
| 2010/0244438 | A1 | 9/2010 | Johanson |
| 2010/0276512 | A1 | 11/2010 | Nies |
| 2010/0301135 | A1 | 12/2010 | Hunnicutt |
| 2010/0301142 | A1 | 12/2010 | Hunnicutt |
| 2010/0327083 | A1 | 12/2010 | Kah |
| 2011/0017842 | A1 | 1/2011 | Nations |
| 2011/0036933 | A1 | 2/2011 | Kah |
| 2011/0036993 | A1 | 2/2011 | Mano |
| 2011/0043607 | A1 | 2/2011 | Grier |
| 2011/0045005 | A1 | 2/2011 | Crowley |
| 2011/0049875 | A1 | 3/2011 | Stults |
| 2011/0057048 | A1 | 3/2011 | McAfee |
| 2011/0084151 | A1 | 4/2011 | Dnn |
| 2011/0095521 | A1 | 4/2011 | Crompton |
| 2011/0108637 | A1 | 5/2011 | Kah |
| 2011/0114569 | A1 | 5/2011 | Kim |
| 2011/0121092 | A1 | 5/2011 | Scully |
| 2011/0121097 | A1 | 5/2011 | Walker |
| 2011/0238228 | A1 | 9/2011 | Woytowitz |
| 2011/0239310 | A1 | 9/2011 | Cheng |
| 2011/0248094 | A1 | 10/2011 | Robertson |
| 2011/0248097 | A1 | 10/2011 | Kim |
| 2011/0306169 | A1 | 12/2011 | Ye |
| 2011/0309161 | A1 | 12/2011 | Renquist |
| 2011/0309169 | A1 | 12/2011 | Kah |
| 2012/0012670 | A1 | 1/2012 | Kah |
| 2012/0041606 | A1 | 2/2012 | Standerfer |
| 2012/0043398 | A1 | 2/2012 | Clark |
| 2012/0061489 | A1 | 3/2012 | Hunnlcutt |
| 2012/0118998 | A1 | 5/2012 | Drechsel |
| 2012/0138832 | A1 | 6/2012 | Townsend |
| 2013/0015273 | A1 | 1/2013 | Onofrio |
| 2014/0014738 | A1 | 1/2014 | Walker |

FOREIGN PATENT DOCUMENTS

| | | |
|---|---|---|
| WO | 2009152980 | 12/2009 |
| WO | 2014011877 | 1/2014 |

* cited by examiner

ARC ADJUSTABLE ROTARY SPRINKLER HAVING FULL-CIRCLE OPERATION AND AUTOMATIC MATCHED PRECIPITATION

CROSS-REFERENCE TO RELATED APPLICATION

This application claims the benefit of U.S. Provisional Patent Application No. 61/602,948, filed Feb. 24, 2013, and incorporated herein in its entirety for all purposes.

FIELD

The field relates to irrigation sprinklers and, more particularly, to rotary irrigation sprinklers having part-circle and full-circle operation capable to automatically match precipitation rates with fluid flow rates and arc adjustments.

BACKGROUND

Pop-up irrigation sprinklers are typically buried in the ground and include a stationary housing and a riser assembly mounted within the housing that cycles up and down during an irrigation cycle. During irrigation, pressurized water typically causes the riser assembly to elevate through an open upper end of the housing and rise above the ground level to distribute water to surrounding terrain. The pressurized water causes the riser assembly to travel upwards against the bias of a spring to the elevated spraying position to distribute water to surrounding terrain through one or more spray nozzles. When the irrigation cycle is completed, the pressurized water supply is shut off and the riser is spring-retracted back into the stationary housing.

A rotary irrigation sprinkler commonly includes a rotatable nozzle turret mounted at the upper end of the riser assembly. The turret includes one or more spray nozzles for distributing water and is rotated through an adjustable arcuate water distribution pattern. Rotary sprinklers commonly include a water-driven motor to transfer energy of the incoming water into a source of power to rotate the turret. One common mechanism uses a water-driven turbine and a gear reduction system to convert the high speed rotation of the turbine into relatively low speed turret rotation. During normal operation, the turret rotates to distribute water outwardly over surrounding terrain in an arcuate pattern.

Rotary sprinklers may also employ arc adjustment mechanisms to change the relative arcuate distance between two stops that define the limits of rotation for the turret. One stop is commonly fixed with respect to the turret while the second stop can be selectively moved arcuately relative to the turret to increase or decrease the desired arc of coverage. The drive motor may employ a tripping tab that engages the stops and shifts the direction of rotation to oscillate the turret in opposite rotary directions in order to distribute water of the designated arc defined by the stops.

There are also rotary sprinklers that can select either part-circle rotation of the turret or full-circle rotation of the turret. In the full-circle rotation mode, the turret does not oscillate between the stops, but simply rotates a full 360° without reversing operation. Such selectable rotary sprinklers generally employ a switching mechanism that decouples the reversing mechanism from the stops.

There is generally a relationship between the amount of water discharged from a sprinkler nozzle relative to its arc of oscillation. This is commonly referred to as the precipitation rate for the sprinkler, and it relates to how much irrigation water is projected onto a ground surface area defined within the arc of rotation. As the arc of rotation is increased or decreased, the flow of water through the nozzle should be adjusted accordingly so that the same precipitation rate is deposited on the ground independent of the sprinkler's arc of rotation. This concept is often referred to as a matched precipitation rate. Previously, a matched precipitation rate was achieved by switching nozzle configurations when the arc is changed by manually removing and inserting different nozzle inserts for each arc setting. As can be appreciated, this is a cumbersome task and requires multiple nozzle inserts configured for specific arcs of rotation. For example, a sprinkler may have one nozzle insert for a 45° arc of rotation and a different nozzle insert for a 90° arc of rotation. For non-standard arc settings (such as a 67° arc of rotation for example), there may not an appropriate standard-size nozzle insert to achieve matched precipitation. Thus, in many instances, the non-standard arc settings often rely on a less then desired nozzle insert that may be mismatched to the selected arc of rotation. That is, a 67° arc of rotation may need to rely on a 45° or a 75° nozzle insert, but such nozzle insert may not be tailored to provide a desired precipitation rate for a 67° arc of watering.

DETAILED DESCRIPTION OF THE PREFERRED EMBODIMENT

Figure 1:
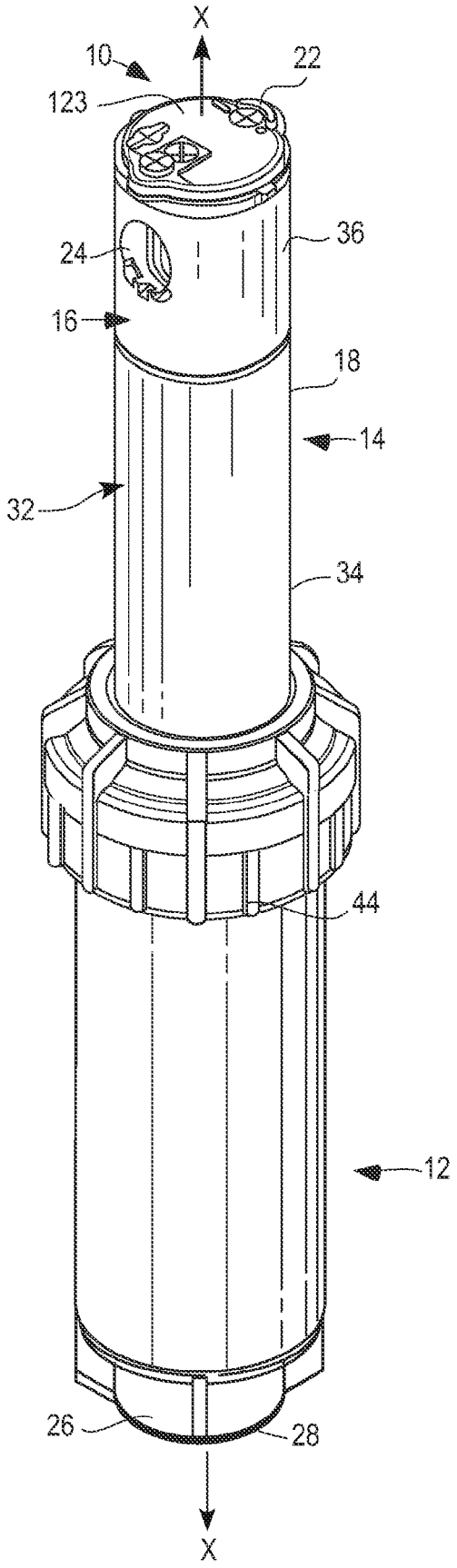
FIG. 1 is a perspective view of an irrigation sprinkler rotor shown with a riser assembly in an elevated position.

A rotary sprinkler is described having a variable shaped nozzle capable of automatically adjusting the shape of the nozzle outlet incident to an adjustment made to the sprinkler. In some approaches, the rotary sprinkler includes automatic matched precipitation coupled to an arc adjustment mechanism to automatically vary the nozzle shape. In other approaches, the rotary sprinkler may include a nozzle purge mechanism to vary the shape of the nozzle and capable of purging a nozzle of dirt, debris, and other particulate without disturbing a set precipitation rate. In yet other approaches, the rotary sprinkler includes a flow shut off valve capable of adjusting the amount of fluid flowing to a nozzle and independently adjusting the shape of the nozzle outlet. In other approaches, the rotary sprinkler may include all such mechanisms or various combinations thereof.

In a first approach, the rotary sprinkler includes a housing with an inlet for receiving fluid for irrigation and defines a longitudinal axis therealong. The sprinkler includes a nozzle defining an outlet with a variable shape for projecting irrigation fluid from the sprinkler. With the rotary sprinkler, the nozzle may be mounted for rotation relative to the housing. A drive mechanism is provided for rotating the nozzle in a reversible arc of rotation between a pair of stops defining ends of the reversible arc of rotation. To adjust the arc of rotation, an arc adjustment mechanism is coupled to at least one of the stops. The arc adjustment mechanism is arranged and configured upon adjustment thereof to increase or decrease an arcuate distance between the pair of stops to increase or decrease the arc of rotation of the nozzle.

To vary the shape of the nozzle, the rotary sprinkler may also include a split gate valve provided at the nozzle outlet. The split gate valve may include at least one flow control member or, in other approaches, two gate vanes disposed on opposing sides of the nozzle outlet. The gate vanes are operably coupled to the arc adjustment mechanism such that adjustment thereof is operable to shift the two gate vanes toward or away from each other at the nozzle outlet to vary the shape of the nozzle outlet. With the gate vanes being adjusted, a corresponding change in the fluid flow rate occurs to adjust the fluid flow rate through the nozzle outlet proportional to the arc of rotation.

In a second approach, a nozzle of the rotary sprinkler may be mounted for rotation relative to the housing and also define an outlet with a first shape for projecting irrigation fluid from the sprinkler to a ground surface area at a predetermined precipitation rate for an arc of rotation. In this approach, the nozzle outlet may also have a second shape for purging the nozzle. A valve at the nozzle outlet may be provided having at least one flow control member configured for shifting in the nozzle to vary the shape thereof from the first shape having a first opening at the nozzle outlet for the predetermined precipitation rate to the second shape having a second larger opening at the nozzle outlet for the nozzle purge.

In order to effect a nozzle purge cycle, the rotary sprinkler may include a nozzle purge actuator (separate from any arc setting mechanism and, in some approaches, other nozzle adjustments) for shifting the at least one flow control member from the first shape to the second shape for temporarily changing the shape of the nozzle outlet from the first opening to the second larger opening for purging the nozzle outlet upon actuation thereof. So that a nozzle purge cycle does not disrupt the shape of the nozzle set for the predetermined precipitation rate, the sprinkler may also include a retention mechanism having at least one valve stop thereon positioned to engage the at least one flow control member. In this manner, the at least one flow control member reverts back to the first shape automatically after a nozzle purge so as not to disturb the precipitation rate. In this approach, the sprinkler is effective to allow a user to purge a nozzle outlet by increasing the size of the outlet opening to dislodge any debris, dirt, or other particulate. At the same time, the valve in the nozzle is also configured to automatically revert back to its set opening size for the desired precipitation rate. In this manner, the user does not need to reset the sprinkler for a desired precipitation rate upon purging the nozzle as with previous rotary sprinklers.

In yet another approach, a rotary sprinkler is provided with a flow control shut off valve configured to vary the shape of the nozzle without affecting the arc stops or nozzle purge settings or other adjustments. In this approach, the rotary sprinkler may include a housing with an inlet for receiving fluid for irrigation and a flow passage therein in fluid communication with the inlet and an outlet. The sprinkler may further include a nozzle defining an outlet with a variable shape for projecting irrigation fluid from the flow passage. As with the other approaches, the nozzle may be mounted for rotation relative to the housing, and in some approaches, mounted for rotation relative to the flow passage. A valve is provided at the nozzle outlet having at least one flow control member configured for shifting in the nozzle to vary the shape of the nozzle outlet.

The sprinkler may further include a separate or independent shut off valve coupled to the flow passage (and separate from the nozzle valve) shiftable from a closed position blocking flow through the flow passage to the nozzle, a fully open position permitting flow through the flow passage to the nozzle, and intermediate positions therebetween. The sprinkler may also include a shut off valve actuator for adjusting the position of the shut off valve between the fully open position, the closed position, and the intermediate positions therebetween. A coupling may be provided between the shut off valve and the at least one flow control member of the nozzle outlet positioned and operable to shift the at least one flow control member in the nozzle to vary the shape of the nozzle outlet incident to adjustment of the shut off valve. In this approach, shut off valve provides an independent flow adjustment to completely shut off fluid flow and hat may also be used to alter the fluid flow to the nozzle without affecting the arc stops and arc of coverage. At the same time, the flow adjustment may alter the nozzle shape to result in a corresponding adjustment to the precipitation rate.

Figure 2:
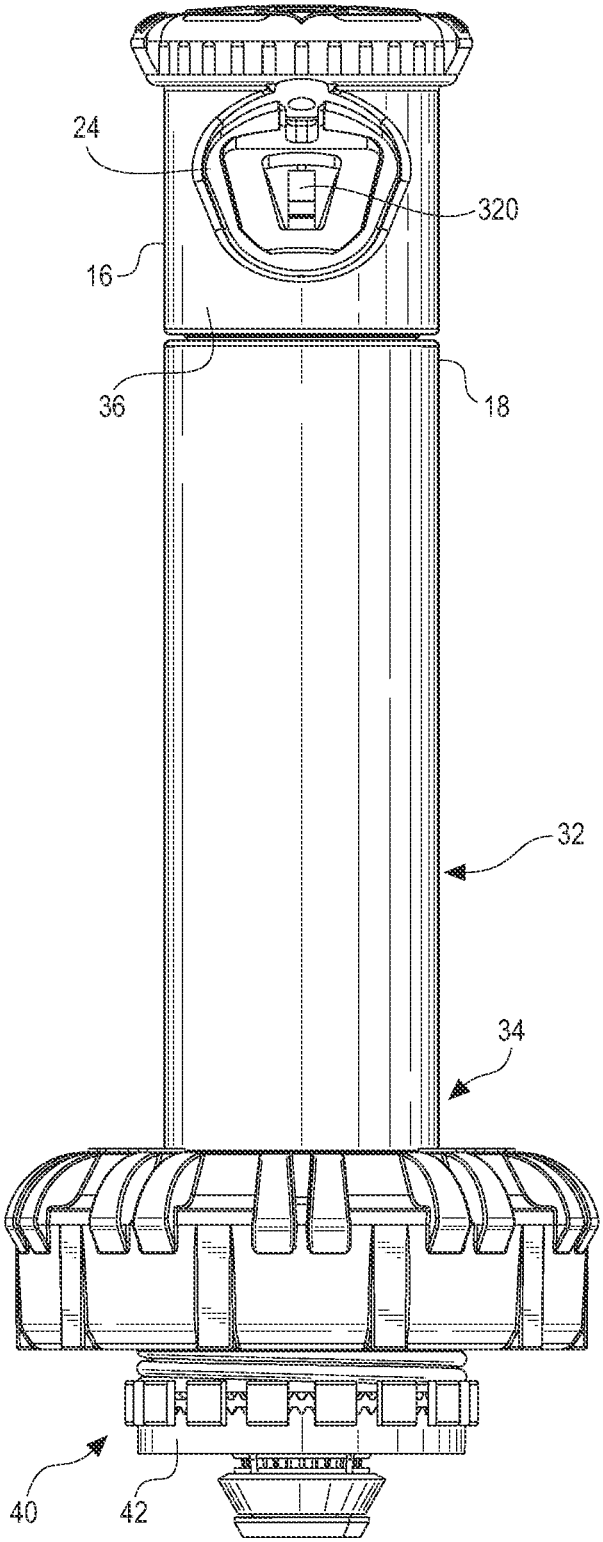
FIG. 2 is another perspective view of an irrigation sprinkler rotor shown with a riser assembly in an elevated position.
Figure 3:
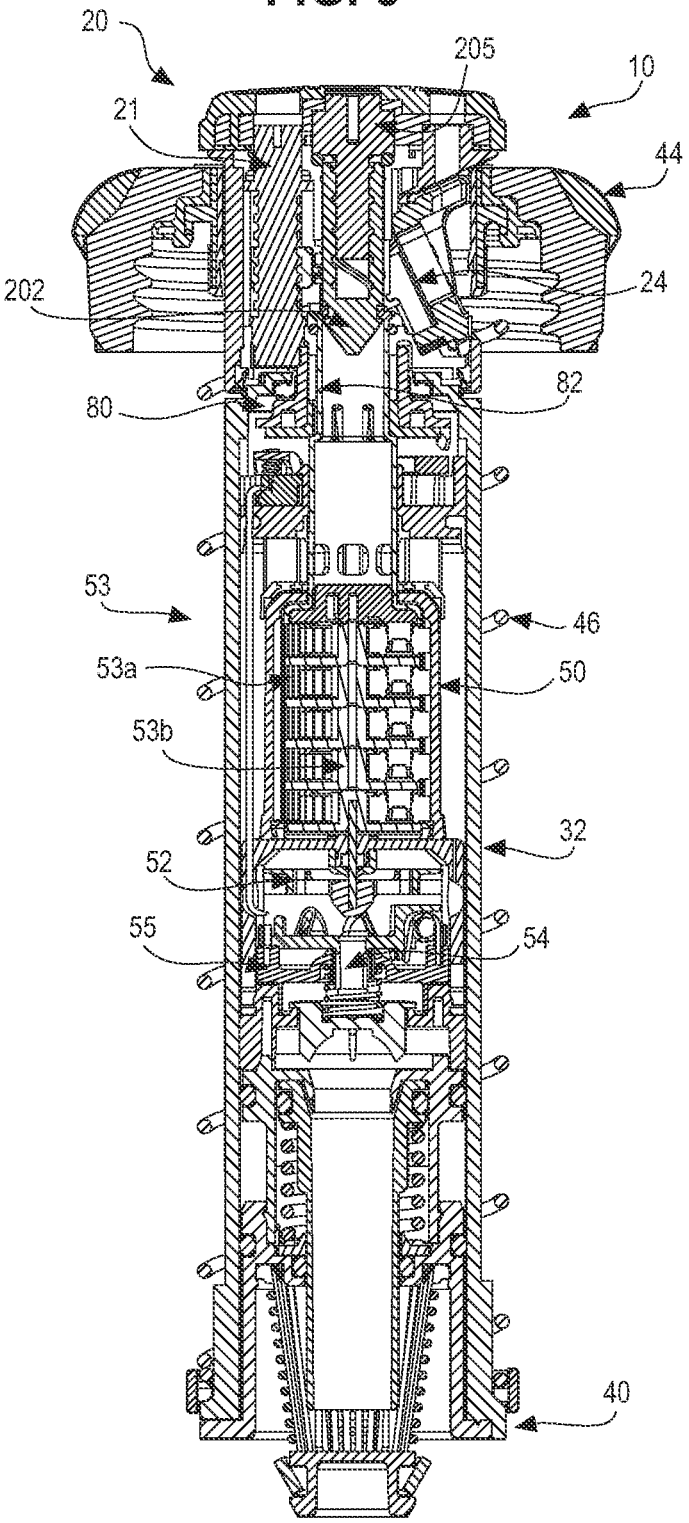
FIG. 3 is a cross-sectional view of an irrigation sprinkler rotor.

Turning to more of the specifics and as generally shown in FIGS. 1-3, one approach of a rotary pop-up sprinkler 10 is provided that includes a housing 12 having a longitudinal axis X, a pop-up riser assembly 14 coupled with the housing 12, and a rotatable nozzle turret 16 on an upper end 18 of the riser assembly 14. In one aspect, the sprinkler 10 includes an arc setting assembly 20 that enables reversing, part-circle operation of the turret 16 or full-circle operation of the nozzle turret 16. Reversing, part-circle operation of the turret 16 is achieved by alternating the direction of fluid flow toward a turbine via a switchable flow director. To aid in switching the flow director, a spring assist member may be employed to help switch the direction of flow toward the turbine.

In another aspect, the sprinkler 10 may also include a nozzle thereof having automatic matched precipitation with the arc setting mechanism. To this end, as one or more of the arc stops used to define opposite arcuate ends of the watering path are adjusted, the nozzle is operative to automatically adjust its configuration to correctly compensate the geometry of the nozzle opening to vary the precipitation rate for the selected arc of watering. In addition, the sprinkler 10 also may include a flow control valve configured and effective to vary the flow rate of fluid flowing towards the nozzle. The flow control valve is also operative to vary the geometry of the nozzle to compensate for the increased or decreased flow to the nozzle to insure generally uniform watering. Thus, the nozzle may have matched precipitation for one or both of the adjustments to flow rate and/or arc of coverage.

In general, the riser assembly 14 travels cyclically between a spring-retracted position where the riser 14 is retracted into the housing 12 (e.g., FIG. 3, with housing 12 removed for clarity) and an elevated spraying position where the riser 14 is elevated out of the housing 12 (FIGS. 1 and 2, with the housing removed in FIG. 2 for clarity). The riser assembly 14 includes the rotatable nozzle turret 16 having at least one nozzle 24 therein for distributing water over a ground surface area. When the supply water is on, the riser assembly 14 extends above ground level so that water can be distributed from the nozzle 24 over the ground surface area for irrigation. When the water is shut off at the end of a watering cycle, the riser assembly 14 retracts into the housing 12 where it is protected from damage.

The housing 12 generally provides a protective covering for the riser assembly 14 and serves as a conduit for incoming water under pressure. The housing 12 preferably has the general shape of a cylindrical tube and is preferably made of a sturdy lightweight injection molded plastic or similar material. The housing 12 has a lower end 26 with an inlet 28 that may be coupled to a water supply pipe (not shown). The sprinklers illustrated herein are only exemplary and may take on other shapes and configurations as needed for a particular application.

As generally shown in FIGS. 1 and 2, the riser assembly 14 includes a non-rotatable, riser stem 32 with a lower end 34 and the upper end 18. The rotatable turret 16 is rotatably mounted on the upper end 18 of the riser stem 32. The rotatable turret 16 includes a housing 36 that rotates relative to the stem 32 to water a predetermined pattern, which is adjustable from part-circle, reversing rotation or to full-circle, non-reversing rotation.

The riser stem 32 may be an elongated hollow tube, which may be made of a lightweight molded plastic or similar material. The lower stem end 34 may include a radially projecting annular flange 40 as shown in FIG. 2. The flange 40 preferably includes a plurality of circumferentially spaced grooves 42 that cooperate with internal ribs (not shown) of the housing 12 to prevent the stem 32 from rotating relative to the housing 12 when it is extended to the elevated position under normal operation, but can be ratcheted when torque is applied to the riser 12. A coil spring 46 for retracting the riser assembly 14 back into the housing 12 is disposed in the housing 12 about an outside surface of the riser assembly 14.

Full and Part-Circle Rotation Turret and Drive Mechanism

Turning to more of the specifics and to FIGS. 3-6, the sprinkler 10 may include a drive mechanism 50, such as a gear-drive assembly, having a water-driven turbine 52 that rotates a gear train or a speed reduction gear drive transmission 53 with, for example, planet gears 53*a* and sun gears 53*b* for turning the nozzle turret 16. An example of a suitable speed reduction gear drive transmission may be similar to that described in U.S. Pat. No. 6,732,950, which is incorporated herein by reference.

Figure 4:
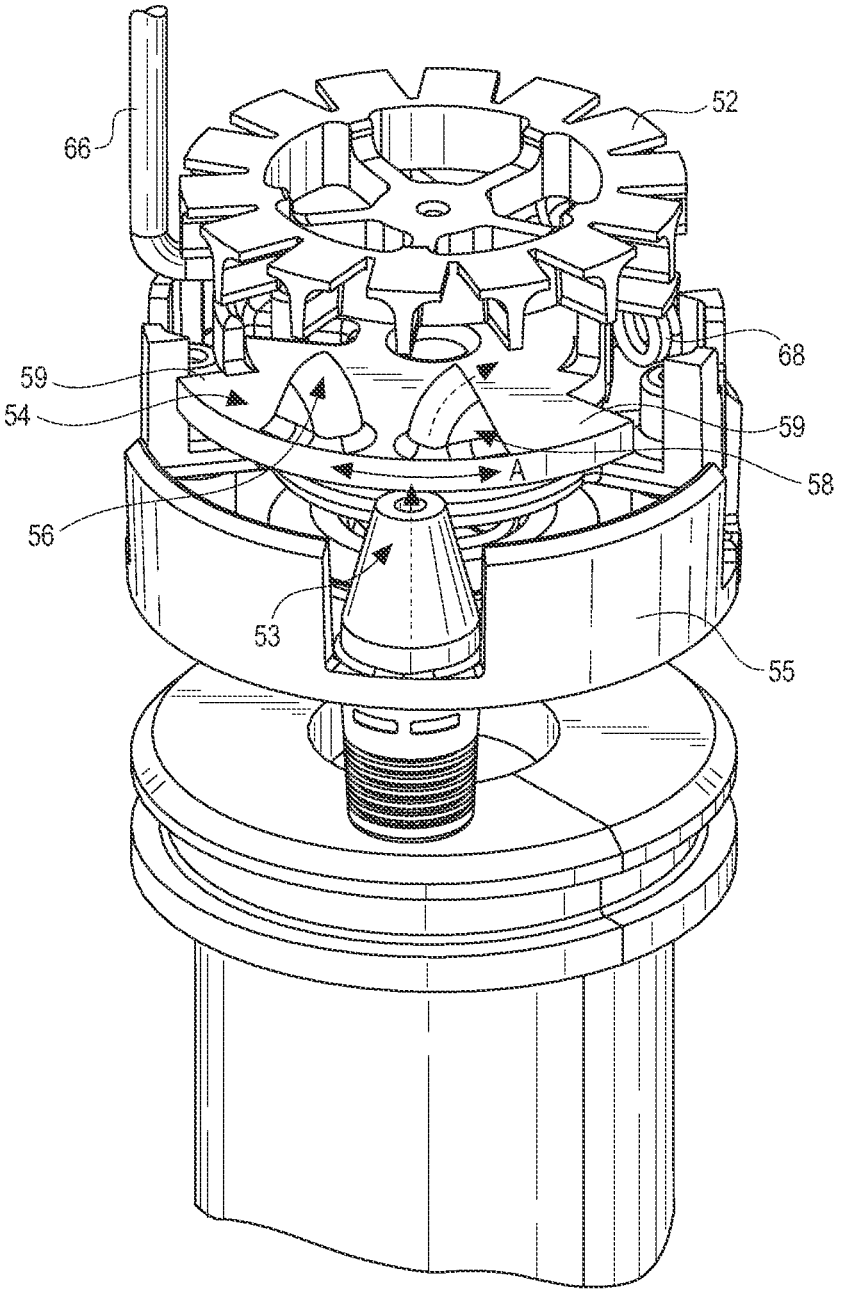
FIG. 4 is a perspective view of a drive mechanism and portions of a selector assembly within a riser of the irrigation sprinkler.
Figure 5:
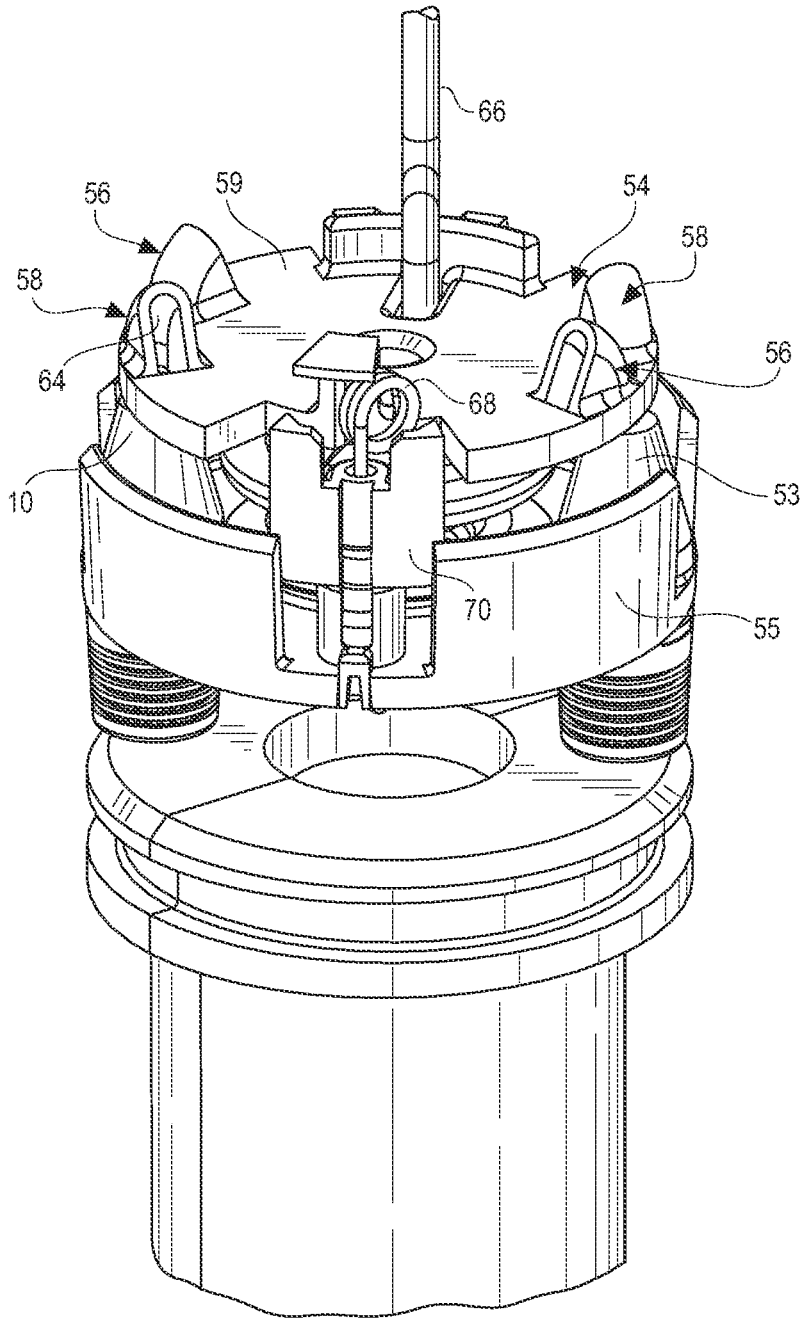
FIG. 5 is another perspective view of portions of the selector assembly of FIG. 4.
Figure 6:
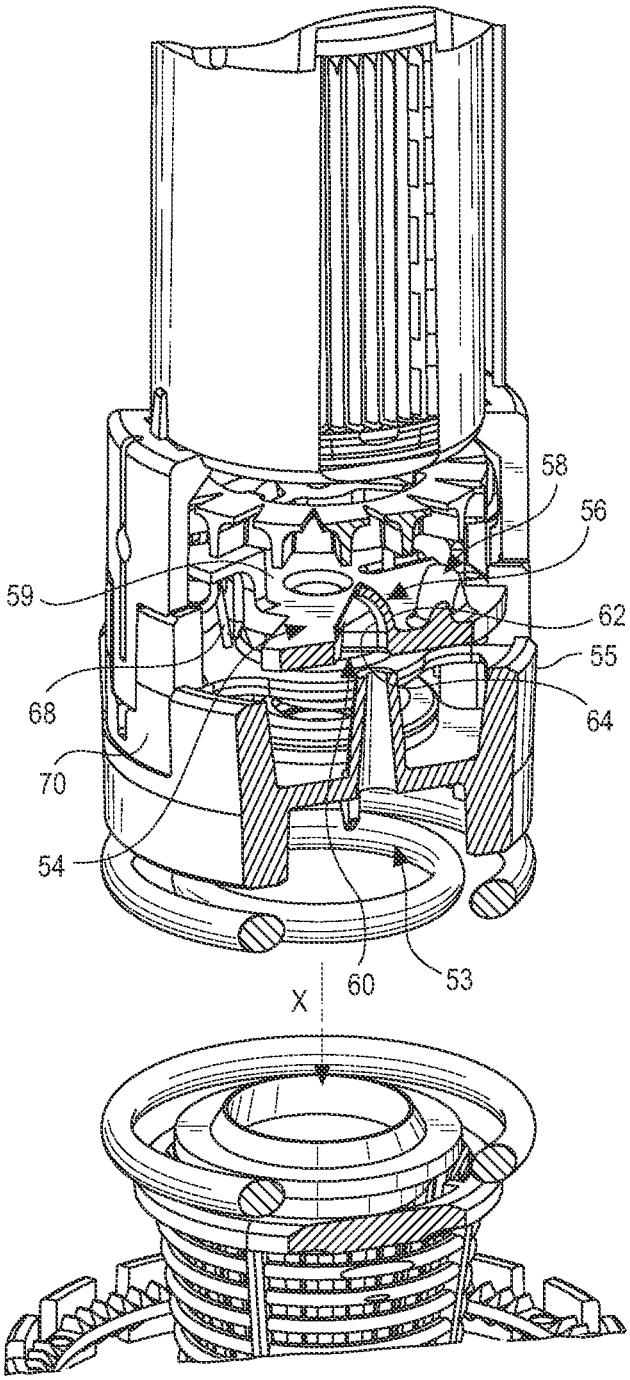
FIG. 6 is another perspective of the drive mechanism and portions of the selector assembly of FIGS. 4 and 5.

The gear train 53 and turbine 52 may be coupled to a shiftable flow director 54 mounted on a support plate 55. The flow director 54 is operative to effect reversing motion to the turret 16 of the sprinkler. In use, water is directed upwardly from a port 53 in the support plate 55 to the flow director 54 and, in particular, to one of two (or more) flow director passages 56 and 58 defined on the plate 54 as shown in FIGS. 4-6. By one approach, the flow director 54 is a disk-shaped plate that has a major surface 59 extending transverse to the sprinkler's longitudinal axis X. As best shown in FIG. 6, the flow director passages 56 and 58 include openings 60 extending through the plate combined with an upper hood 62 to define a flow passage 64. Due to the orientation and/or curvature of inner walls of the passages 56 and 58, when water flows through the left-hand director passage 56, the water flow is directed to impact the drive turbine 52 and turn it to the left, and when the water flows through the right-hand director passage 58, the water flow impacts and turns the turbine 52 to the right.

To effect this shifting, the flow director 54 is configured to toggle back and forth (Arrow A) between two positions (FIG. 4). In a first position, the right-hand passage 58 is positioned above the port 53 so that the water flow (dashed line) is through the flow passage 58 and directed to turn the turbine 52 to the right, which results in rotation of the drive mechanism 50 and associated gears to the right and, thus, the sprinkler rotor also turning to the right. When the sprinkler tripping mechanism (described more below) is triggered, a rotor reversing shaft 66 is toggled to shift the flow director 54 (Arrow A) to a second position for aligning the left-hand passage 56 above the port 53 to now direct water flow in the opposite direction to the turbine 52, which turns the drive mechanism 50 and associated gears to the right and, thus, the sprinkler in the opposite direction.

To assist the flow director 54 in shifting from the first to the second position, the system also includes a spring assist member 68, which may be in the form of a coil-spring or other biasing devise. The spring assist is best shown in FIGS. 4-6 (turbine 30 is removed for clarity in FIG. 5). One end of the coil spring 68 is secured to the director plate 54, and another end of the coil spring 68 is secured to the support plate 55 or a portion 70 operatively connected to the support plate 55 in the sprinkler housing. The end of the coil spring 68 is configured to help urge or snap the director plate 54 over a center location between the two alternating positions when the shaft 66 is toggled back and forth. Alternatively, the spring 68 may resist the movement of the flow director 54 until the shaft 66 is sufficient wound-up or applies a sufficient force to overcome the resistance of the spring 66.

The sprinkler's arc setting assembly 20 allows manual adjustment of the arcuate sweep settings of the nozzle turret 16 by turning an arc set shaft 21 and allows selection between a reversing, part-circle mode and a non-reversing full-circle mode. Referring again to FIG. 3 and also to FIGS. 7 and 8, one form of the arc setting assembly 20 includes an actuator 21, a first arc adjustment or trip stop 80 carried by a ring gear 82, and a second or fixed arc adjustment or trip stop 84.

Figure 7:
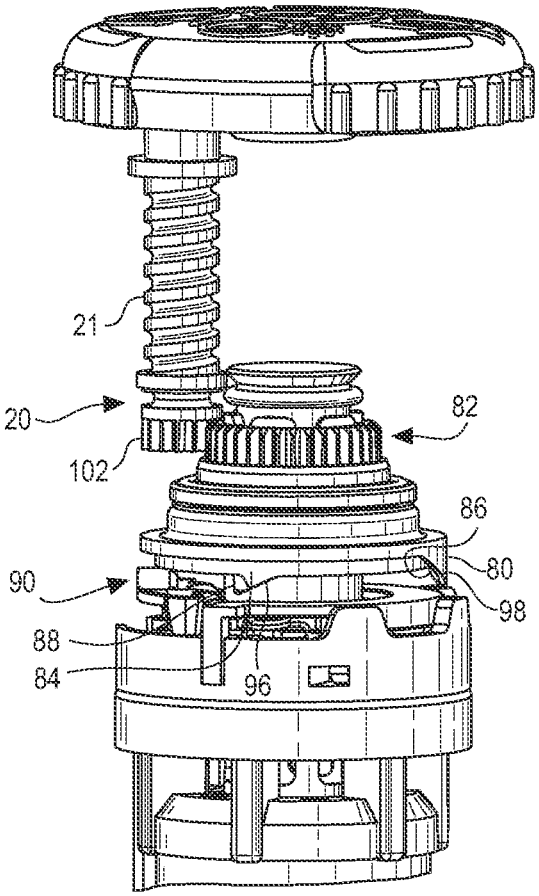
FIG. 7 is a perspective view of exemplary trip members for the irrigation sprinkler.
Figure 8:
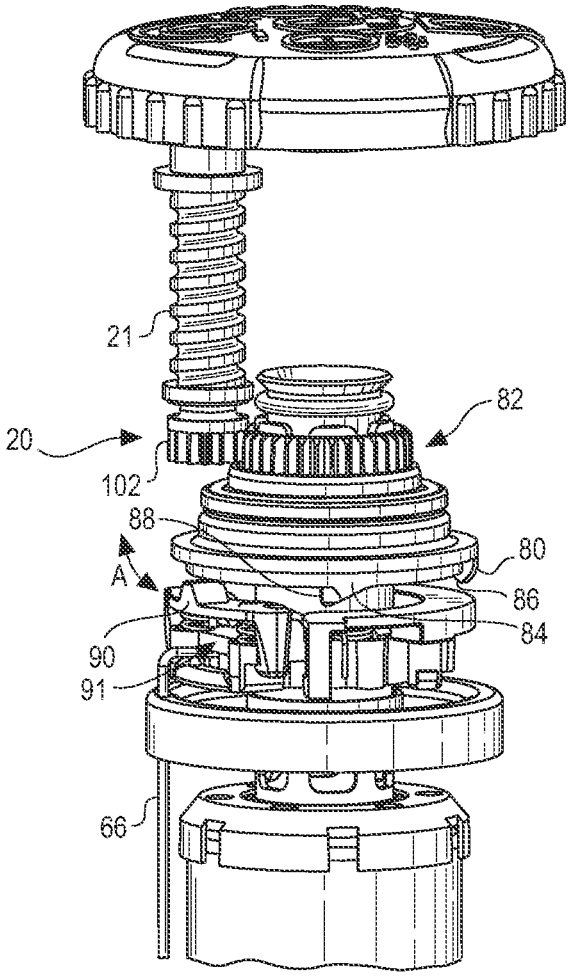
FIG. 8 is another perspective view of the exemplary trip members.

In part-circle mode, the two stops 80 and 84 are spaced circumferentially about the outer periphery of the turret as shown in FIGS. 7-8. By one approach, tab 84 is fixed to the turret, and the tab 80 is selectively adjustable relative to the turret. Both tabs, once set, rotate with the turret 16. As the turret 16 rotates, flat inner facing surfaces 86 and 88 of the tabs 80 and 84, respectfully, will eventually engage a tripping bar 90 and, in some approaches, a detent or other protrusion 93 on an upper surface of the tripping bar. This engagement causes the tripping bar 90 to toggle a switching device 91 (operatively connected or mated to the bar 90) left and right (i.e., Arrow A in FIGS. 8 and 10) that reverses operation of the rotor. The switching device 90 is operatively connected to the rotor reversing shaft 66 to transfer switching motion of the tripping bar 90 to the director plate 54 of the drive mechanism 50 as discussed above.

Figure 9:
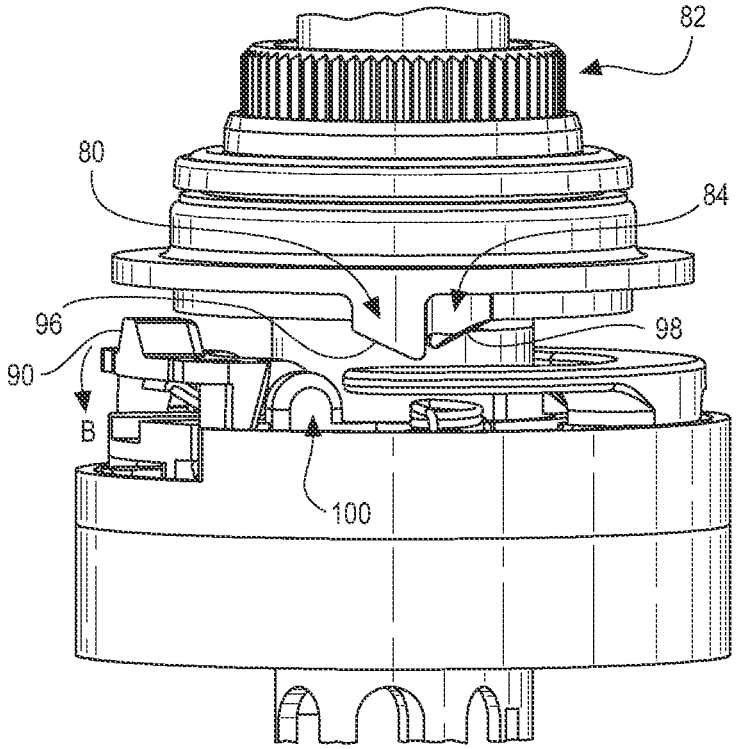
FIG. 9 is a perspective view of the trip members shown in a full-circle operational mode.
Figure 10:
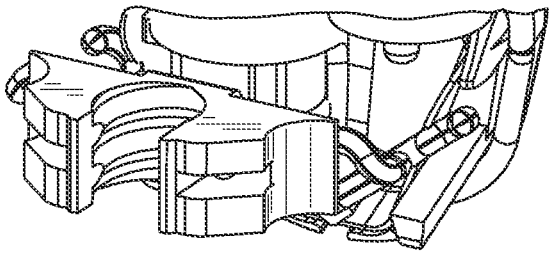
FIG. 10 is a perspective view of an exemplary toggle bar.
Figure 10:
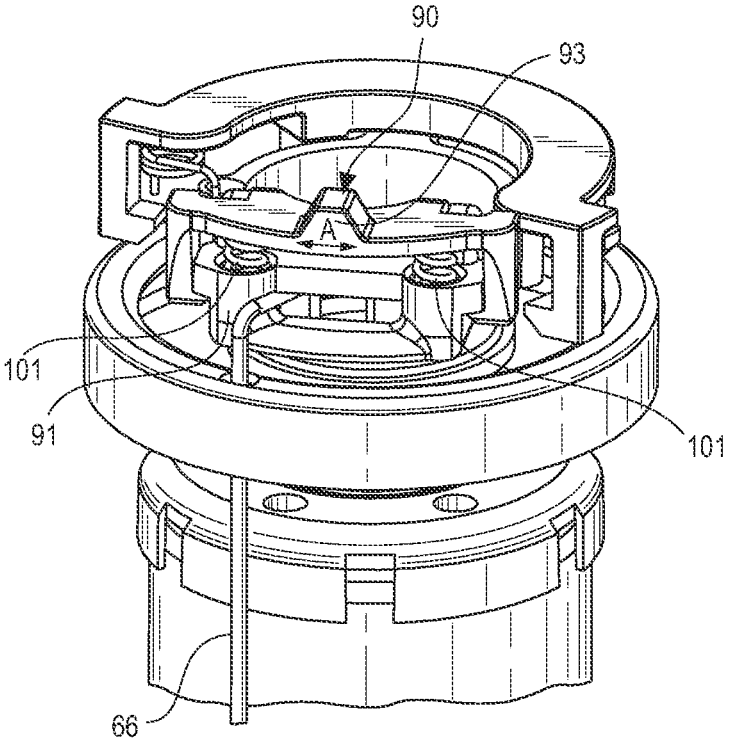

To select full-circle mode, the adjustable arc stop 80 is circumferentially adjusted via the actuator, such as the arc set shaft 21, so that it abuts against the fixed arc stop 84 as shown in FIG. 9. In this mode, the coupled stops 80 and 84 have the flat surfaces 86 and 88 abutting or adjacent each other so that the pair of stops 80 and 84 forms an upside down roof-shaped configuration 94 having two inclined surfaces 96 and 98. As the turret rotates, the inclined surfaces 96 and 98 will eventually engage the tripping bar 90 or protrusion 93 thereon), and one of the inclined surfaces cause the tripping bar 90 to pivot or cam downwardly (Arrow B) about pivot axes 100 and against a biasing member 101 (such as a spring as shown in FIG. 10) rather than toggling the switching device 91 back and forth. The combined stops 80 and 84 then keep rotating in the same direction, and the turret is free to rotate in the same circular direction for 360°.

The biasing member 101 is also advantageous in the part-circle mode discussed above because it provides a vandalism protection allowing the stops to move over the bar 90 under force, such as when someone purposely turns the turret, with the stops pivoting the bar 90 down. When the sprinkler resumes normal watering in part circle mode (i.e., after the vandalism event), the stops 80 and 84 will again engage the bar (and in some cases the protrusion 93) to effect reversing rotation.

To adjust the stop 80, which is operatively coupled to gear 82 and, in one approach, molded in the same piece, a user actuates the actuator 21 that is accessible at the top of the rotor nozzle. To adjust the movable tab 80, the actuator 21 is turned, which has a gear 102 at its distal end mating in a geared relationship with the gear 82. As the actuator 21 is turned, the gear 82 is also turned to effect movement of the tab 86 in a circumferential direction. However, it will be appreciated that other mechanisms and devices may also be used to effect adjustment of the movable tab 80. As discussed in more detail below, the sprinkler 10 may also include automatic matched precipitation based on the arcuate setting of the stop tabs 80 and 84 so that the precipitation rate is automatically matched depending on the size of the arcuate sweep of the rotor. In this manner, there is generally no or little need to manually replace the nozzle upon changing the arcuate sweep of the rotor.

Flow Shut-Off Mechanism

Figure 11:
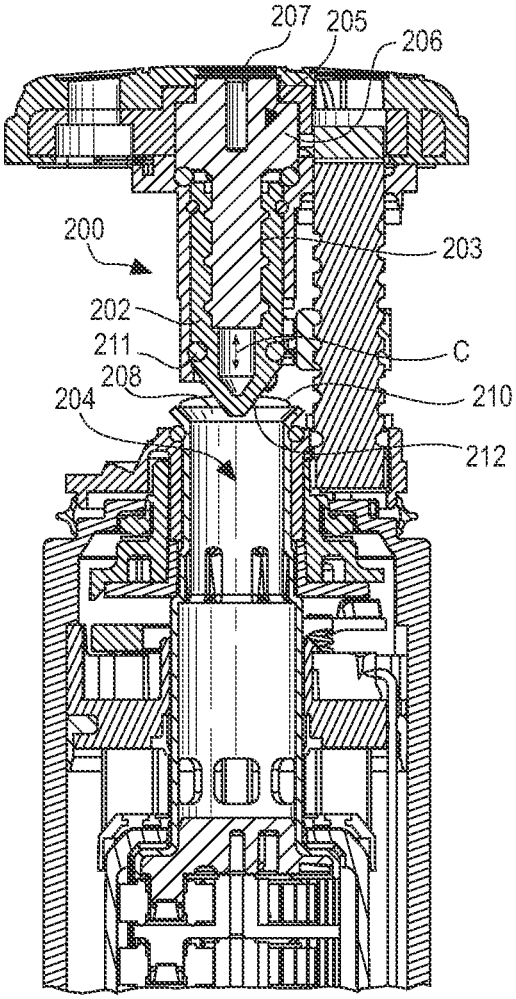
FIG. 11 is a cross-sectional view of a flow control device.

Turning now to FIG. 11, a cross-sectional view of the sprinkler 10 is illustrated to show an exemplary flow shut-off or flow-control valve 200. In this view, parts of the sprinkler turret assembly and components thereof are removed for clarity. In one approach, the shut-off valve 200 includes a plunger 202 positioned coaxial to an upwardly directed flow tube 204 that directs fluid upwardly towards the nozzle 24. The plunger 202 moves axially upwardly and downwardly (Arrow C) in response to a user turning an actuator 205, which is shown as the exemplary threaded shaft 206. By one approach, the actuator shaft 206 is threadably coupled to the plunger 202 where a threading on an outer surface of the shaft 206 is mated to threading on an inner surface of a bore 203 of the plunger 202. Thus, as the user turns the shaft 206 (typically by inserting a screwdriver in a slot 207 at an upper surface of the nozzle turret 16), the plunger 202 is configured to shift axially up (Arrow C) and down within the flow tube 204. If the plunger 202 is moved far enough, it will completely close off an opening or aperture 208 at an upper end 210 of the flow tube 204, which completely blocks water flow to the nozzle. A sealing member 211, such as an o-ring, on the plunger 202 may form a fluid tight engagement between the plunger 202 and the flow tube 204.

If the plunger 202 is moved to intermediate position within the opening 208 of the flow tube, where it only partially blocks the aperture 208 (such as generally shown in FIG. 11) then it will decrease the flow of water to the nozzle 24. By one approach, the plunger 202 has a tapered or pointed lower end 212 configured to progressively restrict nozzle flow as it is lowered into the flow tube 204. The tapered end 212 decreases the size of the flow tube opening 208 to restrict flow to the nozzle 24. As discussed in more detail below, the sprinkler 10 may also include automatic matched precipitation based on the relative position of flow shut off mechanism and, in particular, the relative position of the plunger 202 in the flow tube 204.

Nozzle Purge Mechanism

The sprinklers herein may also include a nozzle purge mechanism 300 arranged and configured so that an outlet opening 302 in the nozzle 24 may be selectively increased in size, shape, geometry, and/or configuration in order to allow a purging or flushing of the nozzle 24 to permit any dirt or debris to be purged or removed therefrom. After purging, the nozzle outlet opening 302 will revert back to its original condition. FIGS. 12 to 15 illustrate one form of the nozzle purge mechanism 300.

By one approach, the nozzle 24 includes a variable area orifice 304 that is configured to increase and decrease the size, shape, geometry and/or configuration of the outlet 302 based upon actuation by a user. When the nozzle purge mechanism 300 is actuated, the variable area orifice is changed in size and area to create a different nozzle outlet opening 302 permitting purging of the nozzle 24.

The variable area orifice includes portions at the nozzle outlet opening 302 that are configured to move or shift in order to change the size, shape geometry, and/or configuration of the outlet opening. By one approach, the variable area orifice 304 may include a valve member 306 at the nozzle outlet 302, such as, for example, a gate valve, a butterfly valve, a port valve, globe valve, and the like. The valve 306 has at least one or two (or more) shiftable members or portions thereof that are adjustable at the nozzle outlet opening 302 for changing the size, shape, geometry, and/or configuration of the nozzle opening 302.

Figure 12:
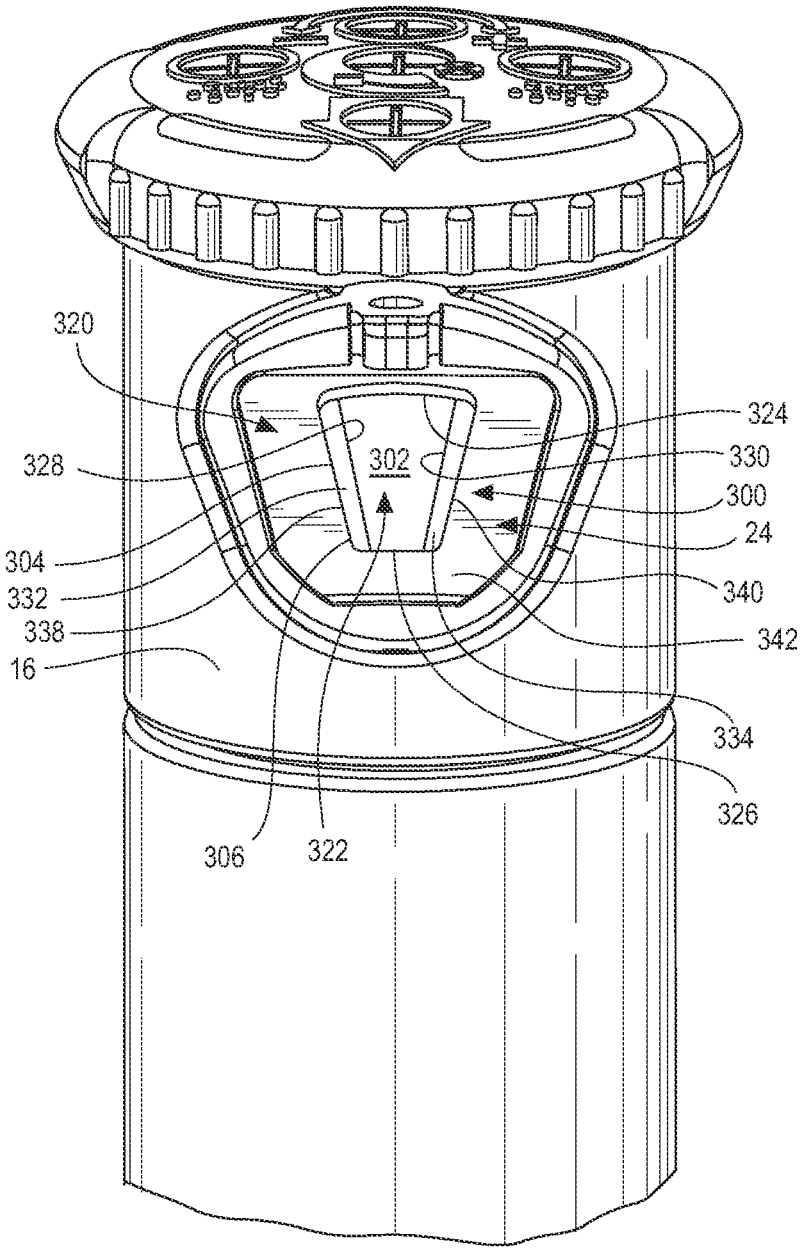
FIG. 12 is a perspective view of an adjustable nozzle valve.
Figure 13:
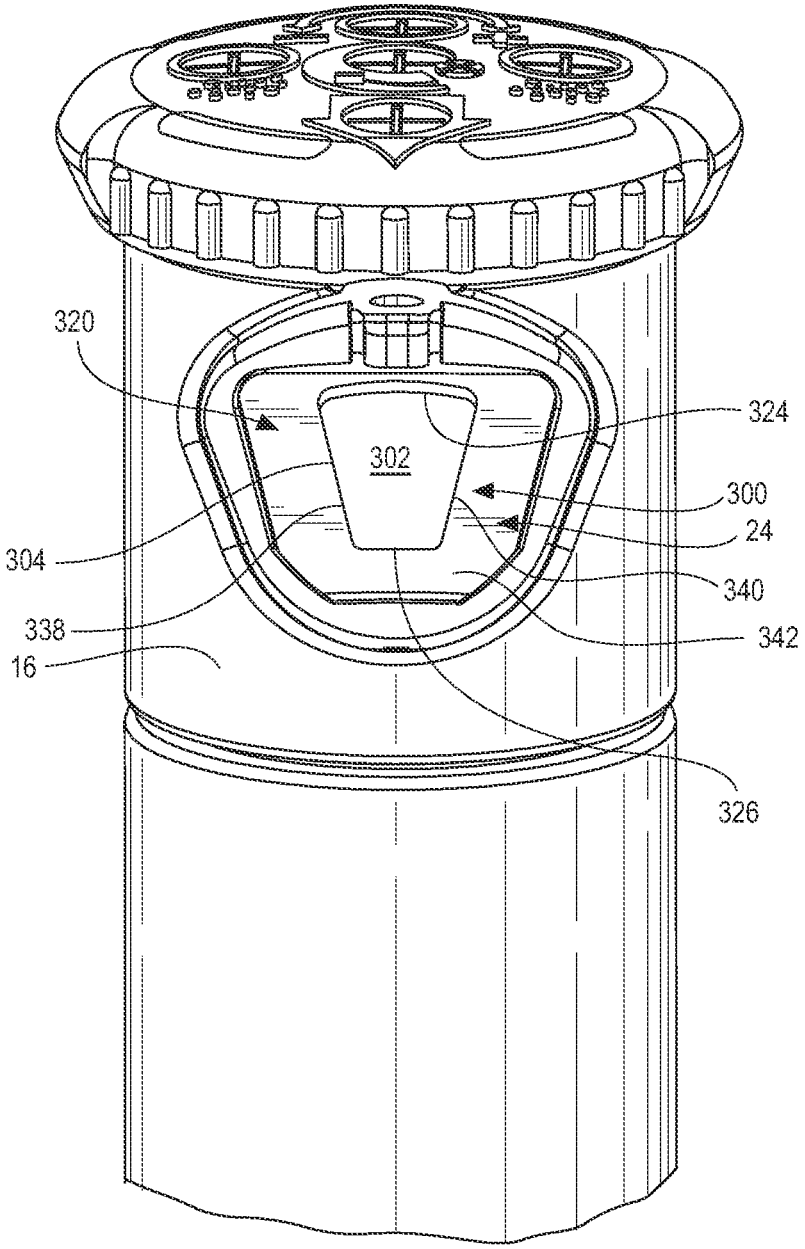
FIG. 13 is another perspective view of the adjustable nozzle valve.
Figure 14:
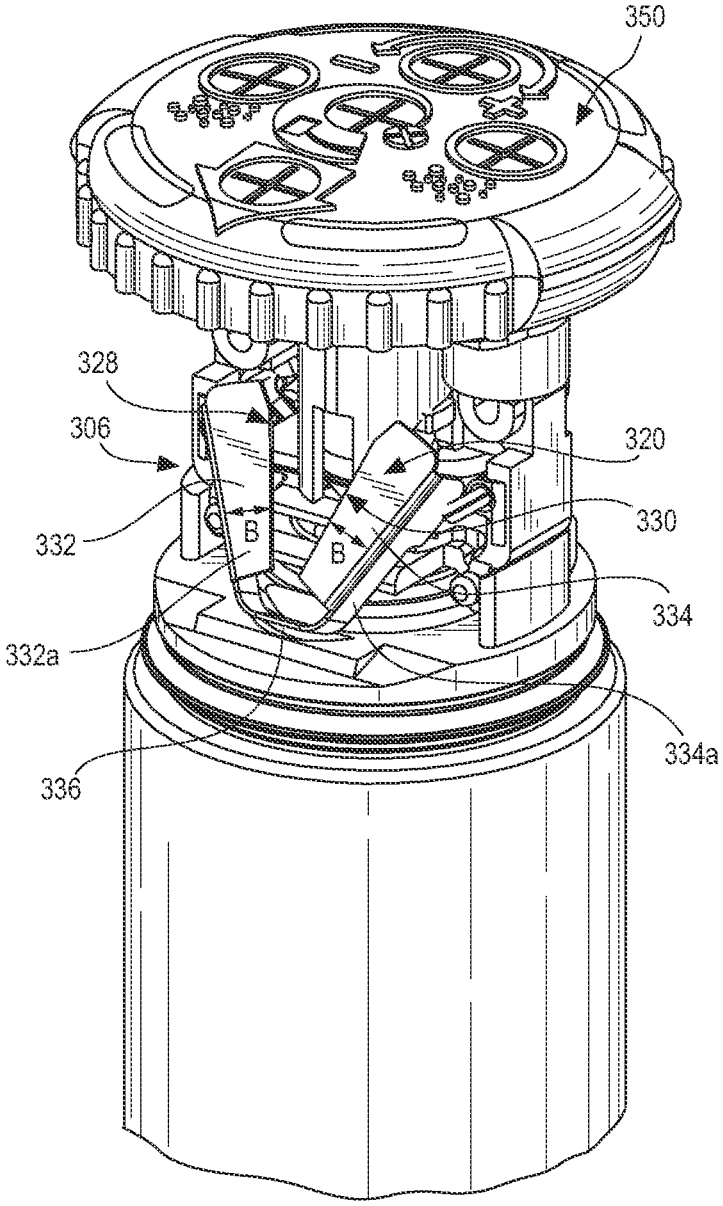
FIG. 14 is a perspective view of a split gate valve for the adjustable nozzle valve.

More specifically, one approach is shown in FIGS. 12-14 in the form of a modified gate valve 320 at the nozzle outlet opening 302. In this approach, the variable area orifice 304 provides a first outlet opening 322 partially defined by edges 324 and 326 of the nozzle 24 (in this approach, upper and lower edges thereof) and partially by edges 328 and 330 of the modified gate valve 320 (in this approach, left and right side edges thereof) as best shown in FIG. 12.

In this approach, the gate valve 320 is a split gate valve configuration having two gate portions 332 and 334 on opposite sides of the outlet orifice 302 such as opposing left and right gate valve vanes shown in FIG. 12 and in FIG. 14 in more detail (with the turret wall and nozzle removed for clarity in FIG. 14). The vanes 332 and 334 are arranged and configured to move toward and away from each other to change the size, shape, geometry and/or configuration of the nozzle outlet (i.e., Arrow B). The vanes 332 and 334 are connected via a connecting strip 336 at one end thereof, such as a lower end **332*a* and 334*a* as shown in FIG. 14. Strip or portion 336 may be integrally connected or molded as a unitary piece with the vanes 332 and 334. The connecting strip or portion 336, in one approach, is biased and configured to impart an inwardly directed bias force on each of the vanes 332 and 334 so that the vanes are biased inwardly toward each other in a normal operating or spraying position, such as that shown in FIG. 12, where the vanes are positioned inwardly from the side edges 338 and 340 of the nozzle 24 to define an outlet orifice 322 smaller than that defined by the edges of the nozzle 24. In other approaches, the connecting portion 336 is configured to impart an outwardly directed bias force on each of the vanes 332 and 334** to that the vanes are biased outwardly away from each other and engage a stop that sets the nozzle outlet size.

Upon actuation of the nozzle purge actuator (discussed more below), the vanes 332 and 334 of the modified gate valve 320 are shifted, such as by releasing the inwardly directed bias from the strip 336 on the vanes, to allow the biasing strip to shift the vanes 332 and 334 outwardly to change the size of the outlet opening 302 as shown generally in FIG. 13. In this position, the outlet opening 302 in now defined by the edges 324, 326, 338, and 340 of the nozzle 24 as the vanes 332 and 334 have shifted to a position behind an outer wall 342 defining the nozzle 24. In this purge mode, the changed size of the outlet opening 302 permits dirt, debris, and other obstructions to be flushed from the nozzle. It will be appreciated that the relative size differences between FIGS. 12 and 13 is only exemplary, the operating and purge conditions of the nozzle 24 may vary in size, shape, and configuration as needed for a particular application.

By one approach, the nozzle purge is actuated by an actuator 350 on top of the nozzle turret 16. For example, the actuator may be a biased push-button (not shown) that is operative to shift the opposing gate valve vanes 332 and 334 away from each other to change the size of the nozzle outlet by pushing down a cam actuator (not shown) to convert the pushing motion of the button to the actuating motion to move the valve vanes.

Figure 15:
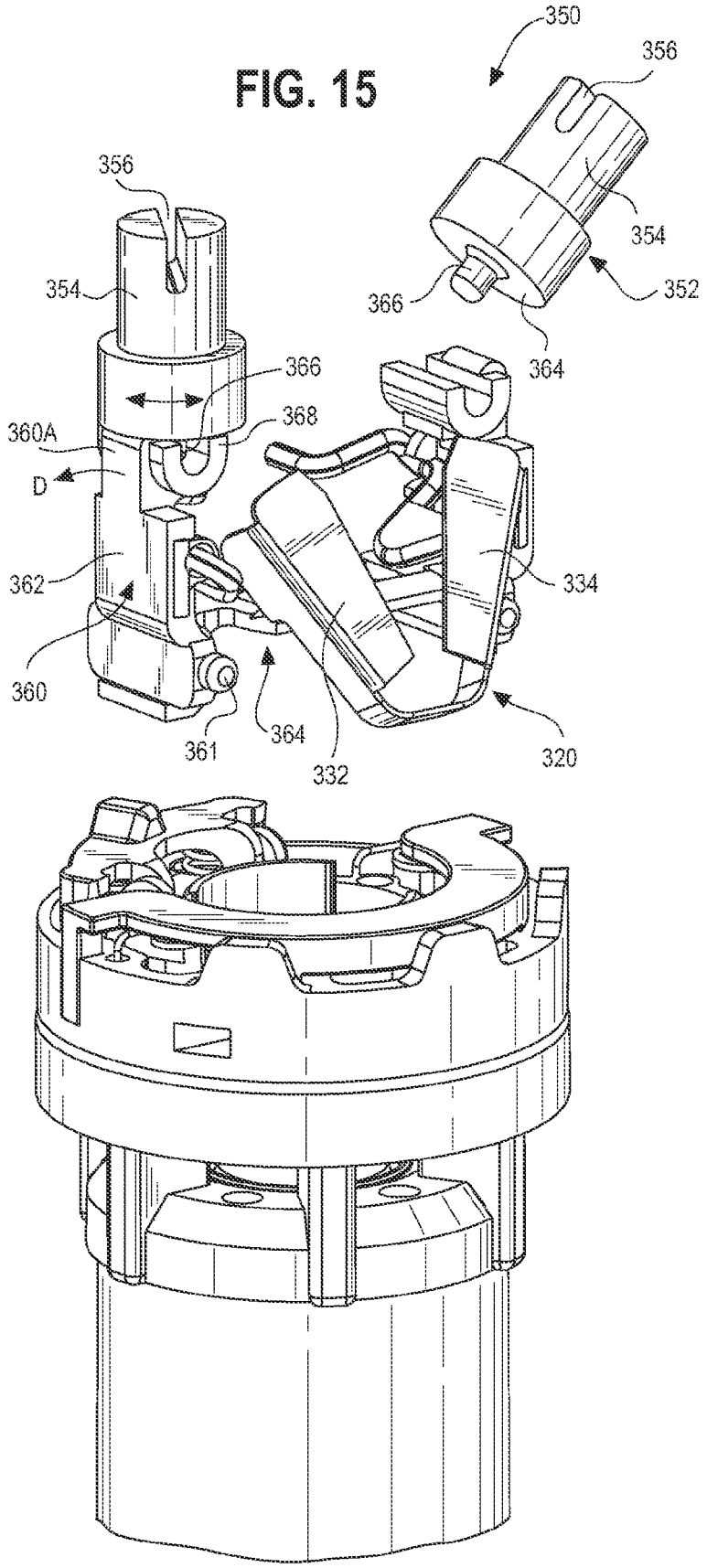
FIG. 15 is a perspective view of an actuator mechanism for a nozzle purge feature of the sprinkler rotor.

Turning to FIG. 15, another form of a nozzle purge actuator 350 is shown. In this approach, the actuator 350 is a rotary actuator 352, which may include two spaced rotary actuators for each side of the split gate valve. For clarity, various components of the nozzle turret are removed in FIG. 15 for ease in showing the rotary actuator 353. A rotary shaft 354, which is accessible via the top of the nozzle turret (not shown here for clarity), is configured for rotation within the nozzle turret 16 to actuate the nozzle purge. By one approach, the shaft 352 include a slot 356 sized for a screwdriver to effect rotation.

To purge the nozzle, the rotary shaft 354 is turned to bias or shift operative portions of a flow actuator override device 360 at a pivot point 361 on proximal ends thereof so that distal ends 360*a* of the device 360 shift in an outwardly direction shown as Arrow D in FIG. 15. The flow actuator override device 360 includes resilient arms 362 or portions thereof that are linked 364 to each of the vanes of split gate valve 320. The outward shifting of the arms 362 allows the biasing force of the connecting strip or portion 336 to shift the vanes 332 and 334 away from each other to change the size of the outlet opening 302 as discussed above. Purging may effect shifting of both override devices 360 at the same time or may effect shifting of only one or the other of the override devices 360 independently from the other.

The right hand rotary shaft 354 is shown removed or spaced from the flow actuator override device 360 for exemplary purposes. In this position, the lower surface 364 of the shaft 354 is visible and illustrates one form of a mechanism to transfer rotary motion of the shaft to the shifting motion of the arms 362. In this approach, the lower surface 364 includes an off-center protrusion 366 that sits in a groove or saddle 368 on an upper end of the flow actuator override arm 362. As the shaft 354 is turned, the off-center protrusion engages sides of the saddle 368 to resiliently bias the arm 362 outwardly (Arrow D). As the shaft 364 is turned one rotation, the arm 362 will shift outwardly to cause a related outwardly shift in the associated valve vane 332, and then the arm 362 and vane 332 will snap back to its original position as the off-center protrusion rotates a full rotation. In this manner, one full turn of the shaft 354 results in a rapid change in outlet 302 size for a quick purge of the nozzle. There may be an audible click or other indication to signal to a user that a purge cycle has occurred. Alternatively, a partial turn of the shaft 354 may cause the arm 332 to shift to a biased position to cause the vane 332 to shift in position, which may be held until the shaft 354 is turned further.

Automatic Matched Precipitation

Figure 16:
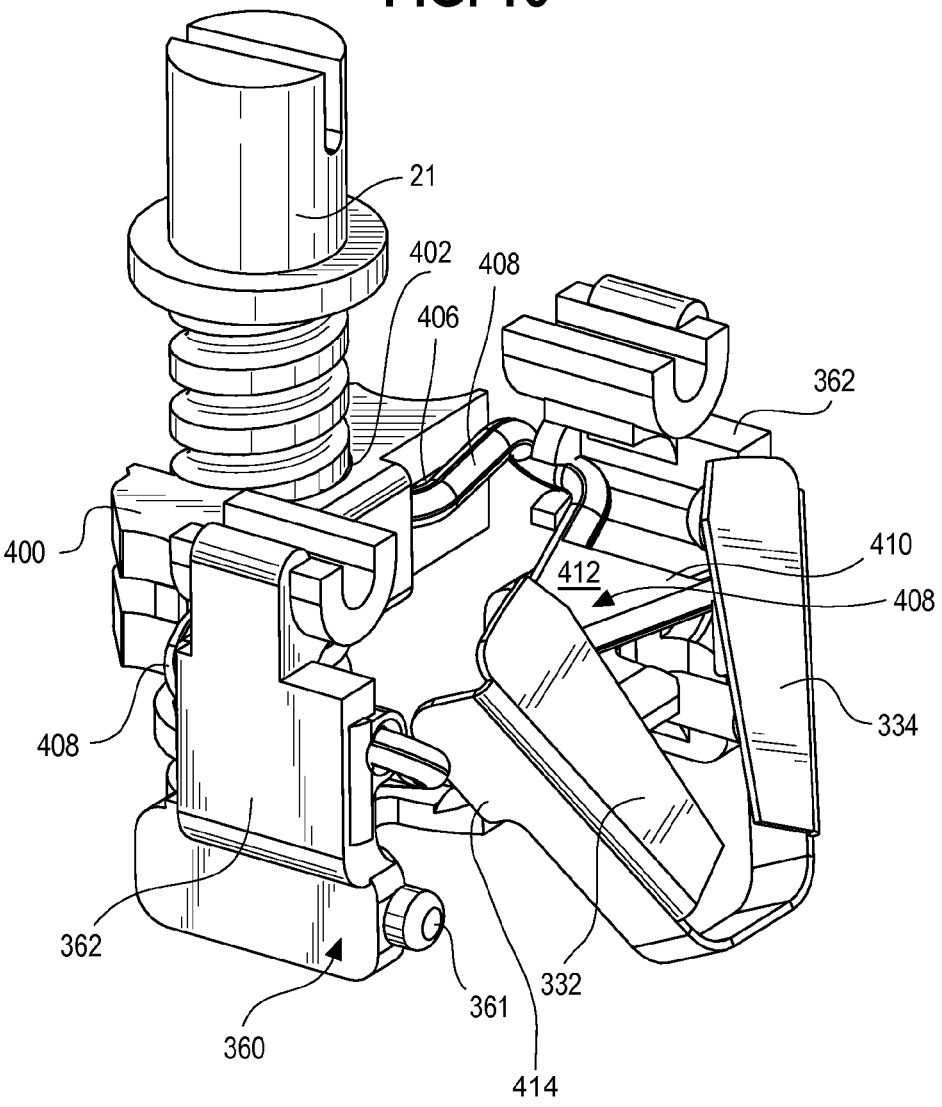
FIG. 16 is a perspective view of a mechanism operative to provide automatic matched precipitation based on the arc settings.
Figure 17:
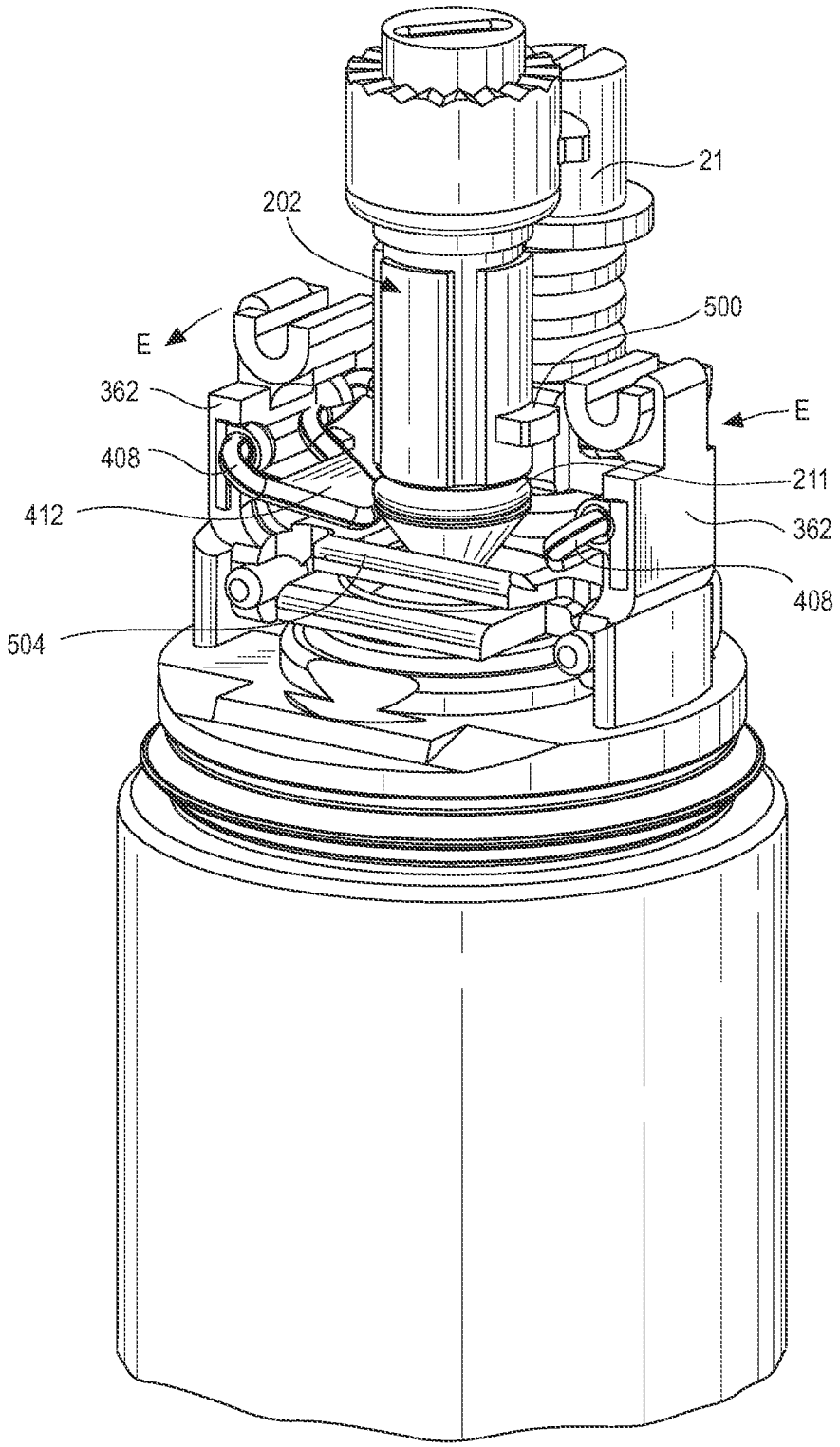
FIG. 17 is a perspective view of a mechanism operative to provide automatic matched precipitation based on flow control settings.

The sprinkler 10 may further include automatic matched precipitation tied to the arc setting mechanism 20 and/or the flow control valve 200. FIGS. 16 and 17 provide one example of mechanisms coupling arc setting and flow control to automatic matched precipitation. In general, the sprinkler 10 may be configured to automatically vary the size, shape, geometry and configuration of the nozzle outlet opening 302 based on changes to the arcuate sweep of the nozzle between the stops 80 and 84 and/or vary the size, shape, geometry, and/or configuration of the nozzle outlet opening 302 based on changes to the flow control valve 200. Such automatic changes generally minimize or limit the need for manual switching of the individual nozzle inserts to change the shape of the outlet.

By one approach and as shown in FIG. 16, the automatic matched precipitation based on arc setting adjustments includes an adjustment shaft traveler 400 that includes a threaded bore 402 to receive the arc set shaft 21 therein. The traveler 400 is configured to move axially along the threaded shaft of the arc adjust shaft 21 as it is turned. In this manner, as the arc set shaft 21 is turned to increase or decrease the arcuate sweep between the stop 80 and 84, the traveler 400 either moves upward or downward along the shaft. Each side edge of the traveler 400 includes a bore 406 that mounts an end of a shaft or linkage 408, such as a bent adjustment shaft or linkage, that is angled to extend through the arm 362 to an opposite enlarged or mating end 410 that abuts with a winged extension 414 on each of the gate valve vanes 332 and 334. Thus, as the set shaft 21 is turned, the traveler 400 moves up or down. The movement of the traveler 400 causes the shaft 408 to rotate or turn within the bore 406, which results in the enlarged mating end 410 to pivot upwardly or downwardly. Since the enlarged mating end 410 engaged the wings 414 of the gate valve vanes, the pivoting of the ends 414 causes the vanes to either move together or apart in a manner similar to that describe above. Thus, the same adjustment shaft 21 used to adjust the arc stops simultaneously also results in a corresponding adjustment to the shape, size, geometry, and/or configuration of the outlet orifice 302 to adjust the precipitation rate to the arc setting.

Turning to FIG. 17, one approach of the automatic matched precipitation based on the flow control valve is shown. In this approach, the plunger 202 includes a protrusion 500 extending outwardly from an outer surface of the plunger 202. As the plunger is driven axially into the flow tube 204, the protrusion 500 is advanced circumferentially and axially downward to a cross bar 504. The cross bar 504 connects opposite arms 362 of the actuator override device 360. As the protrusion engages the cross bar 504, the cross bar is shifted or moved forward resulting in the upper ends of the arms 362 also being moved forward (i.e. Arrows E), which moves the ramps 412 on the shaft 408 forward and results in a corresponding movement of the gate valve vanes (not shown in FIG. 17) due to the engagement of the arms to the vanes via the enlarged ends 414 of the shaft 408. Thus, the same adjustment shaft 205 used to adjust the flow control valve 200 simultaneously also results in a corresponding adjustment to the shape, size, and/or configuration of the outlet orifice 302 to adjust the precipitation rate to the arc setting.

Optional and Alternative Approaches

In alternative or optional approaches, the rotary sprinkler may include a split gate valve includes a linking portion connecting adjacent ends of the two gate valve vanes. The linking portion may a resilient strip providing a biasing force on each of the two gate vanes. The sprinkler may also include a linkage, such as a connecting shaft, between the arc adjustment mechanism and each of the two gate valve vanes. In some approaches, the linkage may be coupled on one portion thereof to the arc adjustment mechanism and coupled on other portions thereof to each of the gate valve vanes such that actuation of the arc adjustment mechanism to adjust the at least one stop simultaneously shifts each of the gate valve vanes toward or away from each other to automatically vary the shape of the nozzle outlet incident to adjustment of the pair of stops.

As mentioned above, each gate valve vane of the split gate valve may also includes a valving portion, such as a flat portion thereof, in the outlet of the nozzle and a winged extension oriented transverse to the valving portion and extending away from the nozzle outlet. In some approaches, the winged extension is coupled to the linkage or shaft mentioned above. The two gate valve vanes may also be disposed on opposite sides of a longitudinal axes extending along the length of the sprinkler housing. In this approach, upper ends of the vanes are configured to shift toward or away from the longitudinal axis upon adjustment of the arc adjustment mechanism for adjusting a shape of the nozzle as described herein.

In some approaches, the sprinkler includes the nozzle purge actuator discussed above where this actuator is independent of the arc adjustment mechanism so that adjustment of the arc stops and/or adjustment of the nozzle purge does not affect the other mechanism. In other approaches, the sprinkler includes a linkage, shaft, or other connection between the arc adjustment mechanism and the at least one flow control member of the valve. In some approaches, the linkage is coupled on a first portion thereof to the arc adjustment mechanism, coupled on a second portion thereof to the at least one flow control member, and coupled on a third portion thereof to the nozzle purge actuator. In this manner, however, the linkage is configured so that actuation of the nozzle purge actuator shifts the at least one flow control member for nozzle purging without adjusting the at least one stop of the arc adjustment mechanism.

In other optional approaches, the sprinkler may also include the nozzle purge mechanism mentioned above. The sprinkler may further include a valve stop configured so that the nozzle shape reverts back to its predetermined position upon completion of a purge cycle. In some approaches, the valve stop is disposed on the second portion of the linkage or shaft discussed above.

In some approaches, the two gate valve vanes are disposed on opposite sides of the housing longitudinal axes and are configured to shift toward or away from the longitudinal axis upon adjustment of the arc adjustment mechanism and independently upon adjustment of the nozzle purge actuator. In this manner, a user can adjust the gate valve vanes by one adjustment along with the arc setting mechanism and through a separate, independent adjustment for purging the nozzle. Neither adjustment affects the nozzle or arc settings of the other when this approach is used.

It will be understood that various changes in the details, materials, and arrangements of parts and components which have been herein described and illustrated in order to explain the nature of the sprinkler may be made by those skilled in the art within the principle and scope of the sprinkler as expressed in the appended claims. Furthermore, while various features have been described with regard to a particular embodiment, it will be appreciated that features described for one embodiment may also be incorporated with the other described embodiments.

What is claimed is:

1. A rotary sprinkler comprising:

a housing with an inlet for receiving fluid for irrigation, the housing having a longitudinal axis;

a nozzle defining an outlet with a variable shape for projecting irrigation fluid from the sprinkler, the nozzle mounted for rotation relative to the housing;

a drive mechanism for rotating the nozzle in a reversible arc of rotation;

an arc adjustment mechanism configured upon adjustment thereof to increase or decrease the arc of rotation of the nozzle; and a split gate valve at the nozzle outlet having two gate vanes disposed on opposing sides of the nozzle outlet, the gate vanes operably coupled to the arc adjustment mechanism such that adjustment thereof is operable to shift the two gate vanes toward or away from each other at the nozzle outlet to vary the shape of the nozzle outlet to adjust a fluid flow rate through the outlet proportional to the arc of rotation, wherein the split gate valve includes a linking portion connecting ends of the two gate valve vanes, and wherein the linking portion is a resilient strip providing a biasing force on each of the two gate vanes.

2. A rotary sprinkler comprising:

a housing with an inlet for receiving fluid for irrigation, the housing having a longitudinal axis;

a nozzle defining an outlet with a variable shape for projecting irrigation fluid from the sprinkler, the nozzle mounted for rotation relative to the housing;

a drive mechanism for rotating the nozzle in a reversible arc of rotation;

an arc adjustment mechanism configured upon adjustment thereof to increase or decrease the arc of rotation of the nozzle; and a split gate valve at the nozzle outlet having two gate vanes disposed on opposing sides of the nozzle outlet, the gate vanes operably coupled to the arc adjustment mechanism such that adjustment thereof is operable to shift the two gate vanes toward or away from each other at the nozzle outlet to vary the shape of the nozzle outlet to adjust a fluid flow rate through the outlet proportional to the arc of rotation, further comprising a linkage between the arc adjustment mechanism and the two gate valve vanes, the linkage coupled on one portion thereof to the arc adjustment mechanism and coupled on other portions thereof to the gate valve vanes such that actuation of the arc adjustment mechanism to adjust the arc of rotation simultaneously shifts the gate valve vanes toward or away from each other to automatically vary the shape of the nozzle outlet incident to adjustment of the arc of rotation, wherein each gate valve vane of the split gate valve includes a valving portion in the outlet of the nozzle and a winged extension oriented transverse to the valving portion and extending away from the nozzle outlet, the winged extension coupled to the linkage.

3. The rotary sprinkler of claim 1, wherein the gate valve vanes are disposed on opposite sides of the longitudinal axes and upper ends thereof are configured to shift toward or away from a location being parallel to the longitudinal axis upon adjustment of the arc adjustment mechanism.

4. The rotary sprinkler of claim 2, wherein the gate valve vanes are disposed on opposite sides of the longitudinal axes and upper ends thereof are configured to shift toward or away from a location being parallel to the longitudinal axis upon adjustment of the arc adjustment mechanism.

* * * * *